US009213279B2

(12) United States Patent
Hirado

(10) Patent No.: US 9,213,279 B2
(45) Date of Patent: Dec. 15, 2015

(54) FIXING APPARATUS

(71) Applicant: CANON KABUSHIKI KAISHA, Tokyo (JP)

(72) Inventor: Yasuharu Hirado, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/944,088

(22) Filed: Jul. 17, 2013

(65) Prior Publication Data

US 2014/0023390 A1 Jan. 23, 2014

(30) Foreign Application Priority Data

Jul. 19, 2012 (JP) ..... 2012-160327
Jul. 4, 2013 (JP) ..... 2013-140617

(51) Int. Cl.
*G03G 15/20* (2006.01)
*G03G 21/20* (2006.01)

(52) U.S. Cl.
CPC ..... *G03G 15/205* (2013.01); *G03G 15/2078* (2013.01); *G03G 21/206* (2013.01)

(58) Field of Classification Search
CPC ..... G03G 15/2078; G03G 21/206; G03G 15/2014; G03G 15/2017; G03G 15/2039; G03G 15/205; G03G 15/2064; G03G 15/2089; G03G 21/20
USPC ..... 399/38, 44, 67, 70, 92, 94, 320, 328, 399/330, 331
See application file for complete search history.

(56) References Cited

U.S. PATENT DOCUMENTS

| | | | | |
|---|---|---|---|---|
| 2004/0101323 | A1* | 5/2004 | Shishikura | 399/44 |
| 2005/0095022 | A1* | 5/2005 | Fujisawa | 399/44 |
| 2005/0238381 | A1* | 10/2005 | Song et al. | 399/93 |
| 2006/0269307 | A1* | 11/2006 | Funabiki et al. | 399/45 |
| 2006/0291894 | A1* | 12/2006 | Chung et al. | 399/92 |
| 2013/0136481 | A1 | 5/2013 | Kaida et al. | |

FOREIGN PATENT DOCUMENTS

| | | | |
|---|---|---|---|
| JP | 2004-013022 | A | 1/2004 |
| JP | 2004-212904 | A | 7/2004 |
| JP | 2007-206275 | A | 8/2007 |
| JP | 2011164320 | A | 8/2011 |
| JP | 2011-248095 | A | 12/2011 |

* cited by examiner

*Primary Examiner* — Benjamin Schmitt
(74) *Attorney, Agent, or Firm* — Fitzpatrick, Cella, Harper & Scinto

(57) ABSTRACT

The fixing apparatus includes a first rotary member that comes into contact with the unfixed toner image, a second rotary member that is heated by the first rotary member and forms the nip portion together with the first rotary member, and an air supply unit that supplies air to the second rotary member. The fixing apparatus is configured to execute a first mode of warming the first rotary member and the second rotary member as a warm-up while rotating the first rotary member and the second rotary member before the fixing process and supplying air with the air supply unit in the fixing process, and a second mode of performing the warm-up for a longer period than in the first mode and supplying air with the air supply unit in the fixing process.

13 Claims, 10 Drawing Sheets

FIXING APPARATUS

BACKGROUND OF THE INVENTION

1. Field of the Invention

The present invention relates to a fixing apparatus to be mounted in an image forming apparatus such as an electrophotographic printer or an electrophotographic copier.

2. Description of the Related Art

As a fixing apparatus to be mounted in an electrophotographic printer or copier, there is known a film heating type fixing apparatus. This type of the fixing apparatus includes a heater having a resistor heating element provided on a ceramic substrate, a fixing film that moves while coming into contact with the heater, and a pressure roller that forms a nip portion together with the heater through intermediation of the fixing film. A recording material bearing an unfixed toner image is sandwiched and conveyed in the nip portion while being heated, and hence the toner image on the recording material is fixed to the recording material. This fixing apparatus has an advantage in that a period necessary for the heater or the fixing film to reach temperature for fixing from start of power supply to the heater (warm-up period) is short.

Therefore, the printer including this fixing apparatus can reduce a period of time from an input of a print instruction to an output of a first copy of the image (first printout time or FPOT). In addition, this type of the fixing apparatus also has an advantage in that power consumption is small during waiting for a print instruction.

However, such a film heating type fixing apparatus is known to cause a phenomenon in which a friction force between the pressure roller and the fixing film is lowered by moisture condensation on an outer circumferential surface of the pressure roller so that the film cannot be rotated (hereinafter abbreviated as "condensation slip").

In the film heating type fixing apparatus, the film and the heater having a small thermal capacity are heated fast, but the pressure roller is not easily heated because the pressure roller has a larger thermal capacity than the film and the heater. Therefore, when the recording material undergoes a fixing process at a timing when the film and the heater reach a target temperature for fixing, the pressure roller is not yet sufficiently heated so that water vapor generated from the recording material is apt to be condensed.

The above-mentioned condensation slip is described below. When the recording material bearing an unfixed toner image is guided into the nip portion, water vapor is generated from the recording material in the process of heating the unfixed toner image. When a surface of the pressure roller is not sufficiently heated, moisture is condensed on the surface of the pressure roller. The fixing film is rotated to follow rotation of the pressure roller by a frictional force between the outer circumferential surface of the fixing film and the surface of the pressure roller in the nip portion. Therefore, when the frictional force is reduced by an influence of the moisture adhering to the surface of the pressure roller, the fixing film may be decelerated or stopped. In the state where the fixing film is decelerated or stopped, it is difficult to convey the recording material. As a result, a sag of the recording material may cause abrasion of an image surface or a paper jam may occur in the fixing apparatus.

In order to suppress occurrence of the condensation slip, there is proposed a structure in Japanese Patent Application Laid-Open No. 2007-206275, in which a air supply fan (blower fan) is used to remove water vapor filled in a periphery of the pressure roller.

However, in the image forming apparatus described in Japanese Patent Application Laid-Open No. 2007-206275, so-called pressure roller contamination (pressure member contamination) may be generated, in which offset toner on the surface of the fixing film, paper powder of the recording material, or the like is adhered and accumulated on the surface of the pressure roller in the nip portion.

The adhesion of toner that can be a main cause of the pressure roller contamination becomes worse more easily as temperature of the surface of the pressure roller becomes lower. When the temperature of the surface of the pressure roller is high, the toner on the surface of the pressure roller is softened so as to adhere to the recording material being conveyed, and hence is removed from the surface of the pressure roller. However, when the temperature of the surface of the pressure roller is low, it is difficult to remove the toner on the surface of the pressure roller.

As described above, there is a problem in that, when the air supply fan is constantly driven as a countermeasure against the condensation slip, the temperature of the surface of the pressure roller is lowered so that the pressure roller contamination is generated easily. The pressure roller contamination causes irregularities of a fixed image, wrinkles of the recording material, tangling of the recording material to the pressure roller, and the like.

SUMMARY OF THE INVENTION

It is an object of the present invention to provide a fixing apparatus that can achieve both suppression of condensation slip and suppression of pressure member contamination.

According to a first embodiment of the invention, there is provided a fixing apparatus for performing a fixing process in which an unfixed toner image is heated in a nip portion while conveying a recording material on which the unfixed toner image is borne to fix the unfixed toner image to the recording material, the fixing apparatus including a first rotary member configured to come into contact with the unfixed toner image, a second rotary member configured to be heated by the first rotary member, the second rotary member configured to form the nip portion together with the first rotary member, and a air supply unit that supplies air to the second rotary member, wherein the fixing apparatus is configured to execute a first mode of performing a warm-up of warming the first rotary member and the second rotary member while rotating the first rotary member and the second rotary member before the fixing process, and supplying air by the air supply unit in the fixing process, and a second mode of performing the warm-up for a longer period than in the first mode and supplying air by the air supply unit in the fixing process.

According to a second embodiment of the invention, there is provided fixing apparatus for performing a fixing process in which an unfixed toner image is heated in a nip portion while conveying a recording material on which the unfixed toner image is borne to fix the unfixed toner image to the recording material, the fixing apparatus including a first rotary member configured to come into contact with the unfixed toner image, a second rotary member configured to be heated by the first rotary member, the second rotary member configured to form the nip portion together with the first rotary member, and a air supply unit that supplies air to the second rotary member, wherein the fixing apparatus is configured to execute a first mode of performing a warm-up of warming the first rotary member and the second rotary member while rotating the first rotary member and the second rotary member, and not supplying air by the air supply unit in the fixing process, and a second mode of performing the warm-up for a longer period than in the first mode and supplying air by the air supply unit in the fixing process.

Further features of the present invention will become apparent from the following description of exemplary embodiments with reference to the attached drawings.

DESCRIPTION OF THE EMBODIMENT

Now, an image forming apparatus and a fixing apparatus according to an embodiment of the present invention are described in detail with reference to the attached drawings.

<General Structure of Image Forming Apparatus>

Figure 1:
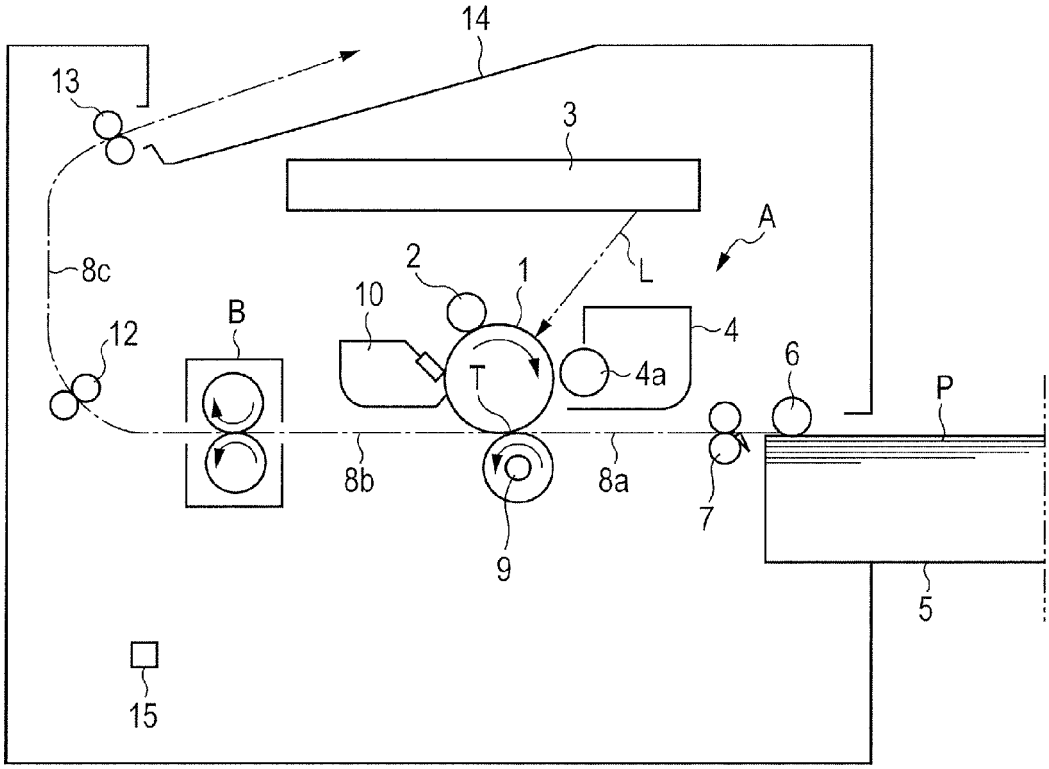
FIG. 1 is a general schematic diagram of an image forming apparatus according to an embodiment of the present invention.

FIG. 1 is a general schematic diagram of an image forming apparatus according to the embodiment of the present invention. This image forming apparatus is a laser beam printer that utilizes an electrophotographic process.

The image forming apparatus described in the embodiment of the present invention includes an image forming unit A for forming an unfixed toner image on a recording material P based on image information, and a fixing unit (hereinafter referred to as "fixing apparatus") B for fixing the unfixed toner image on the recording material to the recording material.

The image forming unit A includes a rotating drum type electrophotographic photosensitive member (hereinafter referred to as "photosensitive drum") 1 as an image bearing member. The photosensitive drum 1 has a structure in which a photosensitive material layer made of OPC, amorphous Se, amorphous Si, or the like is formed on an outer circumferential surface of a cylindrical (drum-like) conductive base made of a metal material such as aluminum or nickel.

The photosensitive drum 1 is rotated in an arrow direction at a predetermined circumferential speed (process speed) in accordance with a print instruction issued from an external device such as a host computer or a terminal on a network. Further, in this rotation process, an outer circumferential surface (surface) of the photosensitive drum 1 is charged uniformly by a charging roller (charging unit) 2 at a predetermined polarity and potential. The charged surface of the photosensitive drum 1 is scanned and exposed by a laser beam L that is emitted from a laser beam scanner (exposing unit) 3 and is modulated (turned on and off) in accordance with image information from the external device. Thus, an electrostatic latent image corresponding to a target image information is formed on the surface of the photosensitive drum 1.

A developing sleeve 4*a* disposed in a developing unit 4 causes toner to adhere to the electrostatic latent image so as to develop the electrostatic latent image as a toner image.

On the other hand, the recording material P stacked and stored in a feed cassette 5 is fed one by one and is conveyed to a registration roller 7 when a feed roller 6 rotates. This recording material P is sent out by the registration roller 7 at a predetermined control timing through a first sheet path 8*a* to a transfer nip portion T formed of the surface of the photosensitive drum 1 and a surface of a transfer roller 9. Then, this recording material P is sandwiched by the surface of the photosensitive drum 1 and the surface of the transfer roller 9 in the transfer nip portion T and is conveyed in this state. In this conveyance process, the transfer roller 9 is supplied with a transfer bias having an opposite polarity to that of the toner. Thus, the toner image on the surface of the photosensitive drum 1 is transferred onto the recording material P in the transfer nip portion T so that the recording material P bears the unfixed toner image.

The recording material P bearing the unfixed toner image is discharged from the transfer nip portion T and is guided to a fixing nip portion (nip portion) N of the fixing apparatus B through a second sheet path 8*b*. Then, this recording material P passes through the fixing nip portion N so that the unfixed toner image is fixed to the recording material P. The recording material P after exiting the fixing apparatus B is conveyed to a third sheet path 8*c* by a convey roller 12 and then is discharged onto a discharge tray 14 by a discharge roller 13.

The surface of the photosensitive drum 1 after separating the recording material P is cleaned by a cleaning unit 10 so that remaining toner or the like after the transfer is removed, and the photosensitive drum 1 is used for next image formation.

In FIG. 1, there is disposed a temperature and humidity sensor (environment detection unit) 15. This temperature and humidity sensor 15 is mounted to an image forming apparatus main body constituting a housing of the image forming apparatus so as to measure temperature and humidity of an environment in which the image forming apparatus is installed.

<Fixing Apparatus B>

In the following description, as to the fixing apparatus and members constituting the fixing apparatus, a longitudinal direction means a direction orthogonal to a recording material conveyance direction in a plane of the recording material. A short-side direction means a direction parallel to the recording material conveyance direction in the plane of the recording material. A longitudinal width means a length in the longitudinal direction. A short-side width means a length in the short-side direction.

Figure 2:
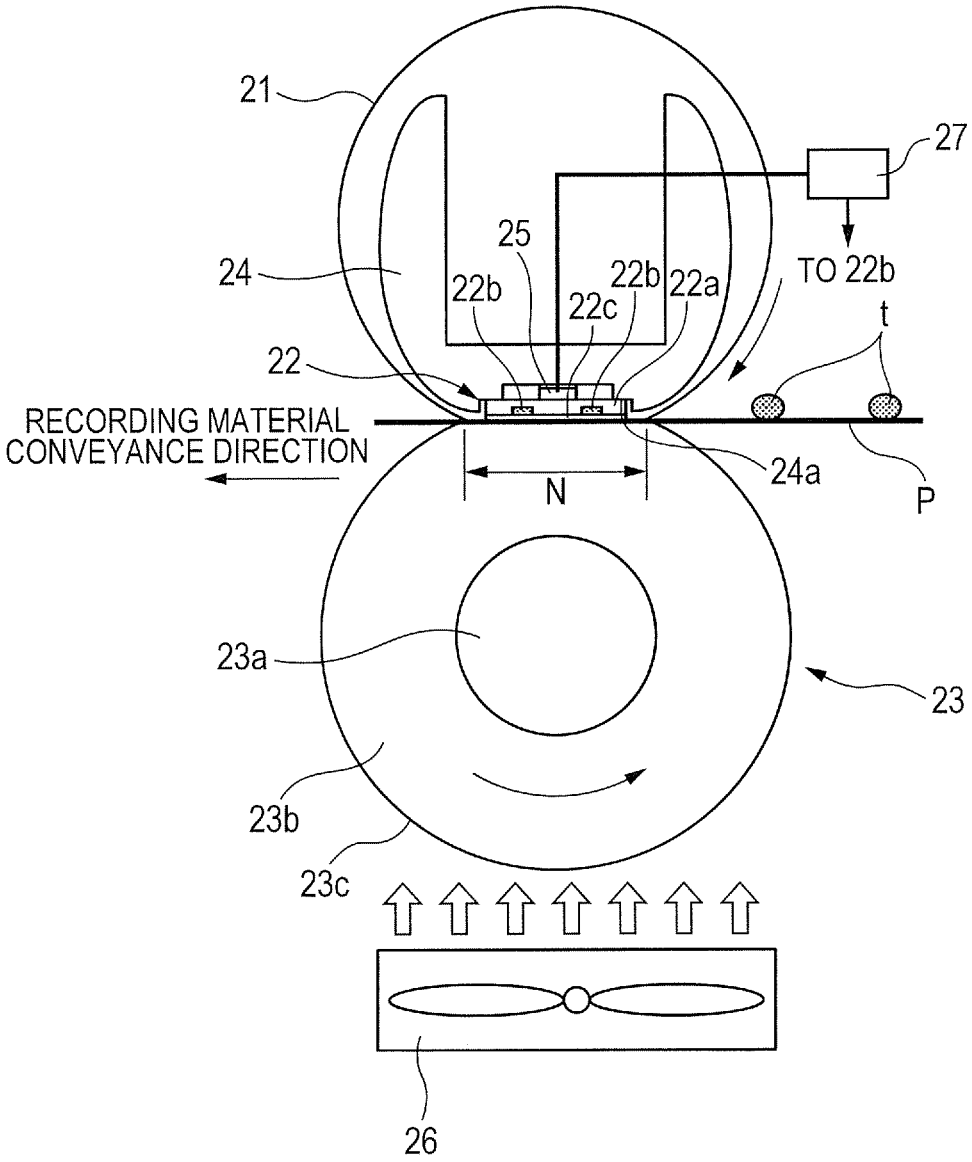
FIG. 2 is a general schematic diagram of a fixing apparatus according to the embodiment of the present invention.

FIG. 2 is a general schematic diagram of the fixing apparatus B. This fixing apparatus B is a film heating type fixing apparatus.

The fixing apparatus B includes a cylindrical fixing film (first rotary member) 21 and a pressure roller (second rotary member) 23 that comes into contact with the fixing film 21 so as to form the fixing nip portion N. Further, the fixing apparatus B includes a ceramic heater (heater) 22 that comes into contact with an inner surface of the fixing film 21, and a film guide (support member) 24 that supports the ceramic heater 22 and guides the inner surface of the fixing film 21. The fixing film 21, the ceramic heater 22, the film guide 24, and the pressure roller 23 are all members elongated in the longitudinal direction. The fixing film 21 is heated by the heater 22 that is maintained at a predetermined temperature (target temperature).

The film guide 24 is formed into a gutter shape having a substantially semicircular arc shape in lateral cross-section. This film guide 24 is a molded component made of a heat-resistant resin such as polyphenylene sulfide (PPS) or liquid crystal polymer. The film guide 24 has a heater supporting groove 24*a* formed along the longitudinal direction in a center of a lower surface in the short-side direction, and this heater supporting groove 24*a* supports the heater 22. Further, the fixing film 21 fits loosely around an outer periphery of the film guide 24. Both end portions of the film guide 24 in the longitudinal direction are fixed to and supported by front and rear side plates of a frame (not shown) of the fixing apparatus B.

The heater 22 is a low thermal capacity heater and includes an elongated substrate 22*a* made of a ceramics having high heat resistance, insulating properties, and good thermal conductivity. On a surface of the substrate 22*a* opposed to the fixing film 21, there is formed a linear or thin band-like resistor heating element 22*b* made of Ag—Pd or the like along the longitudinal direction of the substrate 22*a*. The resistor heating element 22*b* is supplied with power through power supply electrodes (not shown) disposed on both end portions of the substrate 22*a* in the longitudinal direction. Further, on the surface of the substrate 22*a*, there is formed a heat-resistant overcoat layer 22*c* that covers and protects the resistor heating element 22*b*. In the embodiment of the present invention, a resistance value of the resistor heating element 22*b* of the heater 22 is 10Ω at room temperature, and the substrate 22*a* is made of alumina to have a short-side width of 10 mm, a longitudinal width of 370 mm, and a thickness of 1 mm.

It is preferred that the fixing film 21 have a small thickness and a small thermal capacity so as to improve quick start performance. The fixing film 21 of the embodiment of the present invention is an endless film having an outer diameter of 24 mm and including a polyimide film having a thickness of 60 μm and a PTFE-PFA mixed release layer coated on an outer peripheral surface of the polyimide film.

The pressure roller 23 includes a metal core 23*a*, an elastic layer 23*b* formed on the outside of the metal core 23*a*, and a release layer 23*c* formed on the outside of the elastic layer 23*b*. In the embodiment of the present invention, the metal core 23*a* is made of aluminum, the elastic layer 23*b* is made of silicone rubber, and the release layer 23*c* is made of a PFA tube. The pressure roller 23 has an outer diameter of 30 mm, the elastic layer 23*b* has a thickness of 3 mm and a hardness of 55° (Asker hardness C), and the surface of the pressure roller 23 has a thermal conductivity of 0.4 W/(m·K).

This pressure roller 23 is arranged to be opposed to the heater 22 through intermediation of the fixing film 21, and both end portions of the metal core 23*a* in the longitudinal direction are supported by the side plates of the device frame in a rotatable manner. The heater 22 is pressed toward the surface of the pressure roller 23 through intermediation of the fixing film 21 so that the elastic layer 23*b* is elastically deformed, and thus the fixing nip portion N having a predetermined width is formed. In the embodiment of the present invention, a pressure force of the pressure roller 23 toward the fixing film 21 is set to 200 N.

In the fixing apparatus B of the embodiment of the present invention, a drive motor (not shown) is driven to rotate in accordance with a print instruction. Rotation of an output shaft of the drive motor is transmitted to the metal core 23*a* of the pressure roller 23 via a predetermined gear train (not shown), and thus the pressure roller 23 rotates in an arrow direction. The rotation of the pressure roller 23 is transmitted to the fixing film 21 by a frictional force between a surface of the pressure roller 23 and a surface of the fixing film 21 in the fixing nip portion N. Thus, the fixing film 21 rotates in an arrow direction following the rotation of the pressure roller 23 while the inner surface of the fixing film 21 slides on the heat-resistant overcoat layer 22*c* of the heater 22.

In addition, a power supply control unit 27 supplies power to the resistor heating element 22*b* via the power supply electrodes of the heater 22 in accordance with the print instruction. Thus, the resistor heating element 22*b* generates heat, and temperature of the heater 22 is rapidly raised to heat the fixing film 21. The temperature of the heater 22 is detected by a thermistor (temperature detection member) 25 disposed in a region of the back surface of the substrate 22*a* opposite to the fixing nip portion N, in which a large-size recording material and a small-size recording material always pass through. The power supply control unit 27 retrieves an output signal of the thermistor 25 and controls power supply to the resistor heating element 22*b* of the heater 22 based on the output signal. Thus, the fixing film 21 is maintained at a predetermined fixing temperature (target temperature). Further, it is possible to adopt a structure in which the thermistor 25 detects temperature of the fixing film 21.

In a state where the pressure roller 23 is driven to rotate while the heater 22 is supplied with power, the recording material P bearing an unfixed toner image t is guided to the fixing nip portion N with a toner image bearing surface facing upward. The recording material P is sandwiched between the surface of the fixing film 21 and the surface of the pressure roller 23 in the fixing nip portion N and is conveyed in this state (sandwich conveyance). In this conveying process, the unfixed toner image t is heated by the fixing film 21 to melt and is fixed to the recording material by nip pressure in the fixing nip portion N (heating fixing process).

Common structure and operation of the image forming apparatus have been described above in order to describe drive control of a fan according to Examples 1 to 3 described later.

Example 1

In Example 1, supplying air control of a air supply fan 26 is determined based on a result of detecting relative humidity by the temperature and humidity sensor (environment sensor) 15. This case is described below.

Under a low humidity environment, because the recording material P contains a small amount of moisture, there is a small amount of water vapor generated from the recording material P when the unfixed toner image t is fixed to the recording material P in the fixing nip portion of the fixing apparatus B, and hence condensation slip hardly occurs. Therefore, it is possible to stop supplying air by the air supply fan 26 so as to suppress pressure roller contamination when no condensation slip occurs in the low humidity environment.

<Description of Supplying Air Control of Example 1>

Figure 3:
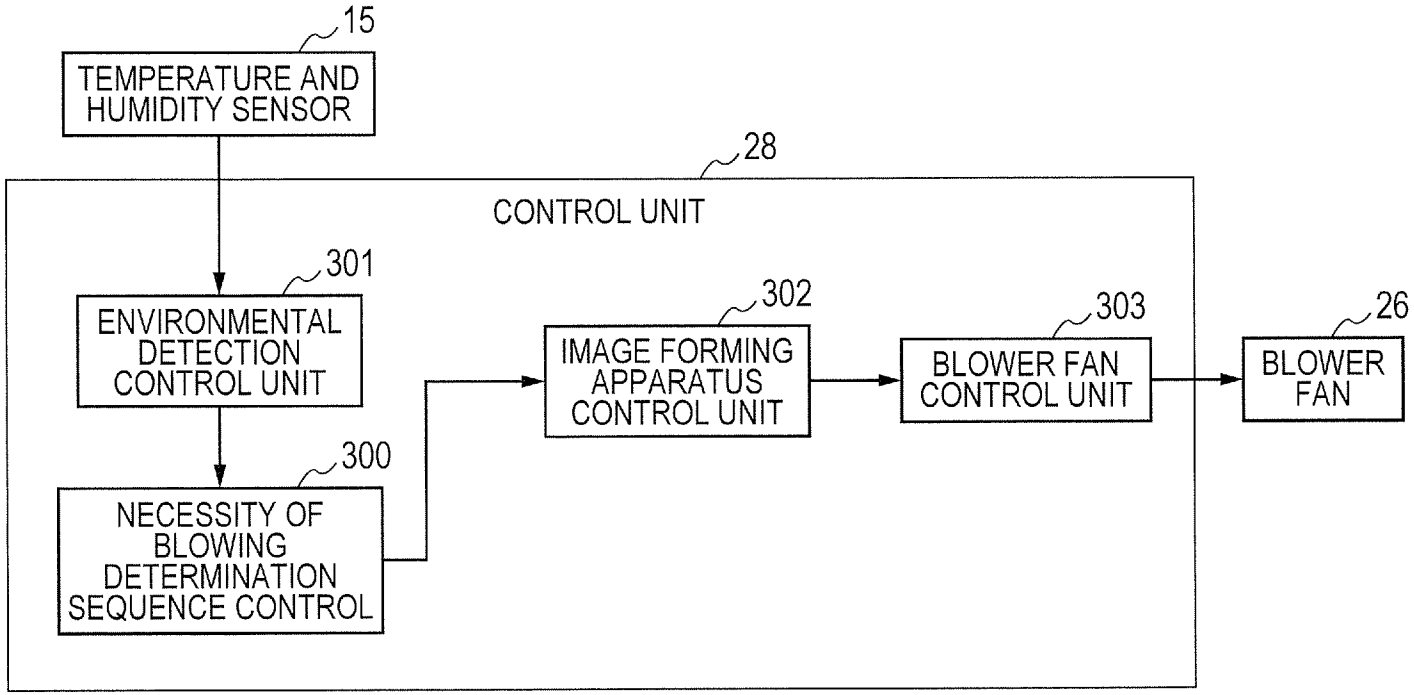
FIG. 3 is a block diagram of a determination of air supply sequence control according to Example 1.

FIG. 3 is a block diagram concerning determination of air supply sequence control according to Example 1. A control unit 28 is constituted of a CPU and memories such as a RAM and a ROM, and includes an environmental detection control unit 301, a determination of air supply sequence control unit 300, an image forming apparatus management control unit 302, a air supply fan control unit 303, and the like.

The management control unit 302 of the image forming apparatus is configured to manage individual control units in the entire image forming apparatus. The environmental detection control unit (environmental detection unit) 301 is configured to retrieve from the temperature and humidity sensor 15 relative humidity measured by the temperature and humidity sensor 15 and to store the relative humidity. The air supply fan control unit 303 is configured to control quantity of airflow from the air supply fan 26 and drive ON/OFF control of the air supply fan 26.

The determination of air supply sequence control unit (determination of air supply unit) 300 is configured to determine whether or not supplying air by the air supply fan 26 is necessary based on relative humidity stored in the environmental detection control unit 301. Criteria for the determination are described below.

Now, correlation among relative humidity, condensation slip, and pressure roller contamination in Example 1 is described. Conditions for investigating the condensation slip and the pressure roller contamination in Example 1 are as shown in Table 1. Each condition is set so that the condensation slip and the pressure roller contamination are easily generated.

TABLE 1

| | Condensation slip | Pressure roller contamination |
|---|---|---|
| Environment temperature | 15° C. | 15° C. |
| Main body print history | Left for three hours from last operation | Left for three hours from last operation |
| Recording material | CS680 A4 (Canon Marketing Japan Inc.) | Extra80 A4 (Canon Marketing Japan Inc.) |
| Fixing target temperature | 200° C. | 200° C. |
| Print ratio | 100% | 5% (character image) |

Each condition is described below.

As to the environment temperature, both the condensation slip and the pressure roller contamination occur more easily as surface temperature of the pressure roller becomes lower in a low temperature environment. In this case, the investigation was carried out in a 15° C. environment, which had the lowest temperature among environments used by a majority of users.

When the temperature of the pressure roller was high based on the main body print history, the investigation was carried out after leaving for three hours or longer so that the surface temperature of the pressure roller was dropped to room temperature.

As to the recording material, condensation slip occurs more easily as a basis weight thereof becomes smaller. This is because, as the basis weight of the recording material becomes smaller, the temperature of the recording material is raised more easily during the fixing process, and a larger amount of water vapor is generated. In addition, contamination of the pressure roller occurs more easily as the basis weight of paper becomes larger because the temperature of the pressure roller is raised less easily during the fixing process. In this investigation, among recording materials that are generally used, CS680 A4 (Canon Marketing Japan Inc.) having a small basis weight was used for investigating the condensation slip, and Extra80 A4 (Canon Marketing Japan Inc.) having a large basis weight was used for investigating the pressure roller contamination.

The target temperature of the heater 22 was set to 200° C. in each paper type.

The print ratio (the ratio of the printed area occupied by pixels of image data when one sheet of a document is printed) was set to 100% so that the entire surface of the recording material was filled with toner because the condensation slip is generated more easily as the print ratio of the recording material becomes higher. Because the pressure roller contamination is generated easily in a low print ratio of the toner image, the character image that is apt to generate transfer dust was set to a density corresponding to the print ratio of approximately 5% in the investigation.

There is described a reason why the toner is apt to accumulate on the pressure roller when the print ratio of the toner image is low. It is because the toner offset to the surface of the fixing film is caused mainly by isolated dot toner that is not easily fixed to the recording material. The isolated dot toner is transfer dust toner generated to scatter in a periphery of a low print ratio image such as a thin line image, fog toner generated in a non-image part due to charge fluctuation of toner, and the like, which are generated more as the print ratio becomes lower.

In addition, the condensation slip depends on the print ratio of the toner image because, when the print surface side of the recording material P is covered with toner, a passage of water vapor generated in the fixing process is blocked so that the water vapor cannot pass through to the print surface side, and hence the water vapor passes through to the pressure roller 23 side, with the result that the amount of water vapor that comes toward the pressure roller 23 is increased.

In the investigation of the condensation slip, the number of recording materials having defects of images was counted when 20 sheets of recording materials were passed through the fixing nip portion. In addition, the pressure roller contamination was investigated by checking and ranking the pressure roller contamination when 10,000 sheets of recording materials were passed through the fixing nip portion.

The ranking of the contamination was evaluated in five ranks (Ranks 1 to 5). Rank 1 indicates that there is no contamination on the pressure roller. Rank 2 indicates such contamination that there are two to three toner spots having a diameter of approximately 1 mm. Rank 3 indicates such contamination that there are approximately 20 toner spots having a diameter of approximately 1 mm. Rank 4 indicates such contamination that there are approximately 50 toner spots having a diameter of approximately 1 mm. Rank 5 indicates such contamination that there are 100 or more toner spots having a diameter of approximately 1 mm. When the pressure roller is contaminated to the extent of Rank 5, the recording material P starts to have a conspicuous defect of image. Because the pressure roller contamination is determined visually, even when the toner spot adhering to the pressure roller has a diameter larger than or smaller than 1 mm, the contamination is evaluated at a corresponding contamination rank.

Table 2 shows situations of generation of the condensation slip and the pressure roller contamination when the supplying air by the air supply fan 26 was constantly performed in each relative humidity environment of Example 1. The condensation slip indicates the number of sheets having image defects when 20 sheets were passed through, and the pressure roller contamination is described by using the above-mentioned contamination rank.

TABLE 2

| | | Condensation slip | Pressure roller contamination |
|---|---|---|---|
| Relative humidity (%) | 90 | 0/20 | Rank 1 |
| | 80 | ↑ | ↑ |

TABLE 2-continued

| | | Condensation slip | Pressure roller contamination |
|---|---|---|---|
| | 70 | ↑ | ↑ |
| | 60 | ↑ | ↑ |
| | 50 | ↑ | ↑ |
| | 40 | ↑ | ↑ |
| | 30 | ↑ | ↑ |
| | 20 | ↑ | Rank 2 |
| | 10 | ↑ | Rank 3 |

In Table 2, no condensation slip is generated in any relative humidity. However, the pressure roller contamination is generated in relative humidity environments of 20% or less. In the low humidity environment, the amount of moisture contained in the recording material P is decreased so that electric resistance of the recording material P is increased. As a result, electrostatic offset is conspicuously generated so that the pressure roller contamination is liable to be generated. When supplying air to the pressure roller 23 is performed by the air supply fan 26 in the state where the pressure roller contamination is easily generated, the pressure roller temperature is dropped, and the pressure roller contamination is generated.

Table 3 shows situations of generation of the condensation slip and the pressure roller contamination when the supplying air by the air supply fan 26 was stopped in each relative humidity environment of Example 1.

TABLE 3

| | | Condensation slip | Pressure roller contamination |
|---|---|---|---|
| Relative humidity (%) | 90 | 19/20 | Rank 1 |
| | 80 | 19/20 | ↑ |
| | 70 | 17/20 | ↑ |
| | 60 | 13/20 | ↑ |
| | 50 | 9/20 | ↑ |
| | 40 | 2/20 | ↑ |
| | 30 | 0/20 | ↑ |
| | 20 | ↑ | ↑ |
| | 10 | ↑ | ↑ |

In Table 3, no pressure roller contamination is generated in any relative humidity. However, the condensation slip is generated in relative humidity environments of 40% or more. In the high humidity environment, the amount of moisture contained in the recording material P increases so that the amount of water vapor generated from the recording material P increases, and hence the condensation slip is easily generated. When supplying air to the pressure roller 23 is not performed by the air supply fan 26 in the state where the condensation slip is liable to be generated, the condensation slip is generated.

The condensation slip is a phenomenon that is caused when water vapor generated in the heating fixing process of the recording material P is condensed onto the surface of the pressure roller 23. Therefore, a first recording material, which enters the fixing apparatus in a state where water vapor is not yet adhered to the pressure roller 23, does not cause an image defect due to the condensation slip. Therefore, when 20 sheets are passed through, the maximum number of sheets having an image defect is 19 sheets. When there is much condensation on the surface of the pressure roller 23, the fixing film 21 may not rotate to follow the rotation of the pressure roller 23 to cause paper jam.

In order to suppress both the condensation slip and the pressure roller contamination, the determination of air supply sequence control is performed in Example 1 so that supplying air by the air supply fan 26 is not performed when the relative humidity is equal to or less than 30%.

Figure 4:
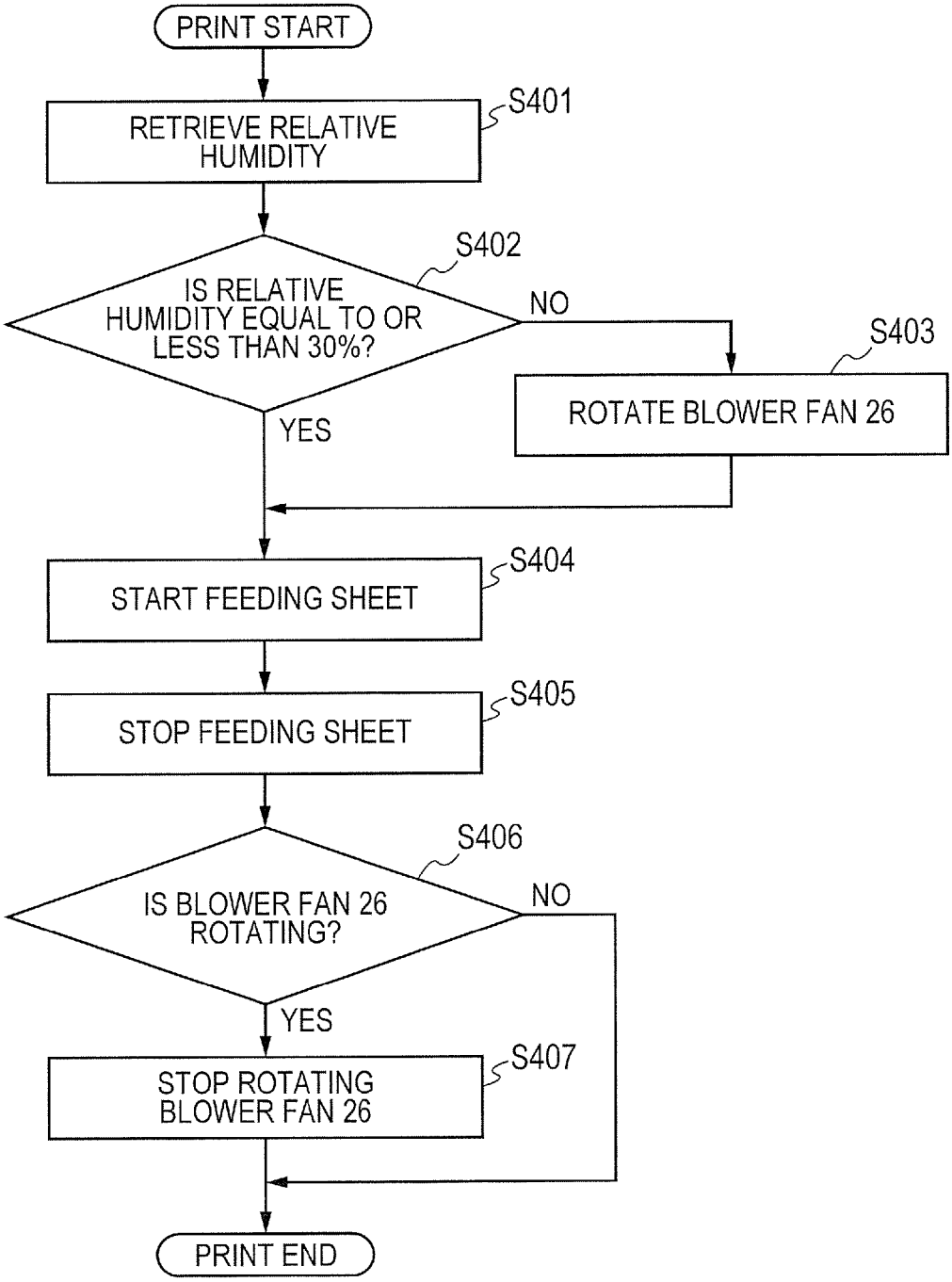
FIG. 4 is a flowchart of the determination of air supply sequence control according to Example 1.

FIG. 4 illustrates a flowchart of the determination of air supply sequence control according to Example 1. When the control unit 28 receives a print instruction, the environmental detection control unit 301 retrieves relative humidity from the temperature and humidity sensor 15 (S401). Thus, the control unit 28 performs the determination of air supply sequence control (S402).

In S402, the determination of air supply sequence control unit 300 determines whether or not relative humidity is equal to or less than 30%. When the relative humidity is equal to or less than 30% (Y), an instruction indicating that the supplying air is not necessary is output to the image forming apparatus management control unit 302. When the relative humidity is more than 30% (N), an instruction indicating that the supplying air is necessary is output to the image forming apparatus management control unit 302.

In S403, in response to the instruction indicating that the supplying air is necessary, the management control unit 302 issues a drive instruction to the air supply fan control unit 303. Based on the drive instruction, the air supply fan control unit 303 drives to rotate the air supply fan motor (not shown) of the air supply fan 26. Thus, the air supply fan 26 rotates and starts supplying air to the surface of the pressure roller 23 and the vicinity of the surface of the pressure roller 23 (see FIG. 2).

In S404, when the management control unit 302 receives one of the instruction indicating that the supplying air is necessary and the instruction indicating that the supplying air is not necessary, the management control unit 302 drives the image forming unit A, the fixing apparatus B, a recording material conveyance control unit (not shown), and the like. Thus, the recording material P bearing the unfixed toner image t is started to pass through the fixing nip portion N.

In S405, when the image forming apparatus management control unit 302 receives a print end signal from a print number counter (not shown), the image forming apparatus management control unit 302 stops driving the image forming unit A, the fixing apparatus B, the recording material conveyance control unit (not shown), and the like. Thus, feeding of sheets to the fixing nip portion N is finished.

In S406, the control unit 302 detects whether or not the air supply fan 26 is rotating. It is detected that the air supply fan 26 is rotating (Y) based on the instruction indicating that the supplying air is necessary in S404, and it is detected that the air supply fan 26 is not rotating (N) based on the instruction indicating that the supplying air is not necessary in S404. When it is detected that the air supply fan 26 is rotating, the process flow goes to S407. When it is detected that the air supply fan 26 is not rotating (N), the printing is finished as it is.

In S407, the management control unit 302 outputs a drive stop instruction to the air supply fan control unit 303. The air supply fan control unit 303 stops rotation drive of the air supply fan motor (not shown) of the air supply fan 26 based on the drive stop instruction. Thus, rotation of the air supply fan 26 is stopped so that the supplying air of air by the air supply fan 26 to the surface of the pressure roller 23 and the vicinity of the surface of the pressure roller 23 is stopped.

Table 4 is a comparison table of the condensation slip and the pressure roller contamination between a conventional example in which supplying air by the air supply fan 26 is constantly performed and Example 1 in which the above-mentioned determination of air supply sequence control is performed.

TABLE 4

| | | Conventional example | | Example 1 | |
|---|---|---|---|---|---|
| | | Condensation slip | Pressure roller contamination | Condensation slip | Pressure roller contamination |
| Relative humidity (%) | 90 | 0/20 | Rank 1 | 0/20 | Rank 1 |
| | 80 | ↑ | ↑ | ↑ | ↑ |
| | 70 | ↑ | ↑ | ↑ | ↑ |
| | 60 | ↑ | ↑ | ↑ | ↑ |
| | 50 | ↑ | ↑ | ↑ | ↑ |
| | 40 | ↑ | ↑ | ↑ | ↑ |
| | 30 | ↑ | ↑ | ↑ | ↑ |
| | 20 | ↑ | Rank 2 | ↑ | ↑ |
| | 10 | ↑ | Rank 3 | ↑ | ↑ |

In the conventional example in which supplying air by the air supply fan 26 is constantly performed, no condensation slip is generated in any relative humidity environment, but the pressure roller contamination occurs in environments having relative humidity of 20% or less. In contrast, in Example 1 in which the above-mentioned determination of air supply sequence control is performed, neither condensation slip nor pressure roller contamination is generated in any relative humidity environment shown in Table 4.

The above description is about the embodiment of the determination of air supply sequence control of Example 1. As described above in Example 1, environments which need supplying air by the air supply fan 26 based on relative humidity are determined, and the supplying air by the air supply fan 26 can be stopped in low humidity environments in which the pressure roller contamination is easily generated. Thus, the image forming apparatus that performs the determination of air supply sequence control of Example 1 can prevent generation of the condensation slip of the recording material P due to condensation of moisture on the surface of the pressure roller 23, and can suppress the pressure roller contamination.

Example 2

Another example of the determination of air supply sequence control is described.

It is known that temperature of an area through which the recording material P does not pass (non-paper passing part) in the longitudinal direction of the heater 22 gradually rises in the film heating type fixing apparatus. This is because that heat of an area through which the recording material P passes (paper passing part) is absorbed by the recording material, but heat of the non-paper passing part through which the recording material P does not pass is not absorbed by the recording material so that temperature of the non-paper passing part continues to rise (hereinafter abbreviated as "temperature rise in the non-paper passing part").

In recent years, along with increase of printing speed in an image forming apparatus, as one of methods of suppressing temperature rise in the non-paper passing part of the fixing apparatus, there is a method of increasing thermal conductivity of the pressure roller so that surface temperature of the pressure roller is dropped. By increasing thermal conductivity of the pressure roller, thermal movement in the longitudinal direction is promoted so that heat in the non-paper passing part of the heater moves to the paper passing part. Thus, temperature rise in the non-paper passing part can be suppressed.

However, as a negative effect of increasing the thermal conductivity of the pressure roller, thermal movement to the metal core of the pressure roller is also promoted so that temperature of the surface of the pressure roller is dropped. As a result, the condensation slip and the pressure roller contamination are increased.

In Example 2, there is described a case of determining relative humidity and image information of the recording material P, particularly determining supplying air by the air supply fan 26 based on the print ratio, which is effective in a case where the condensation slip and the pressure roller contamination are easily generated because of increase of thermal conductivity of the pressure roller.

Because the condensation slip and the pressure roller contamination depend on the print ratio, it is possible to prevent generation of the condensation slip and the pressure roller contamination even when the condensation slip and the pressure roller contamination are increased, by adding print ratio information to criteria for determining supplying air by the air supply fan 26.

<Description of Supplying Air Control of Example 2>

Figure 5:
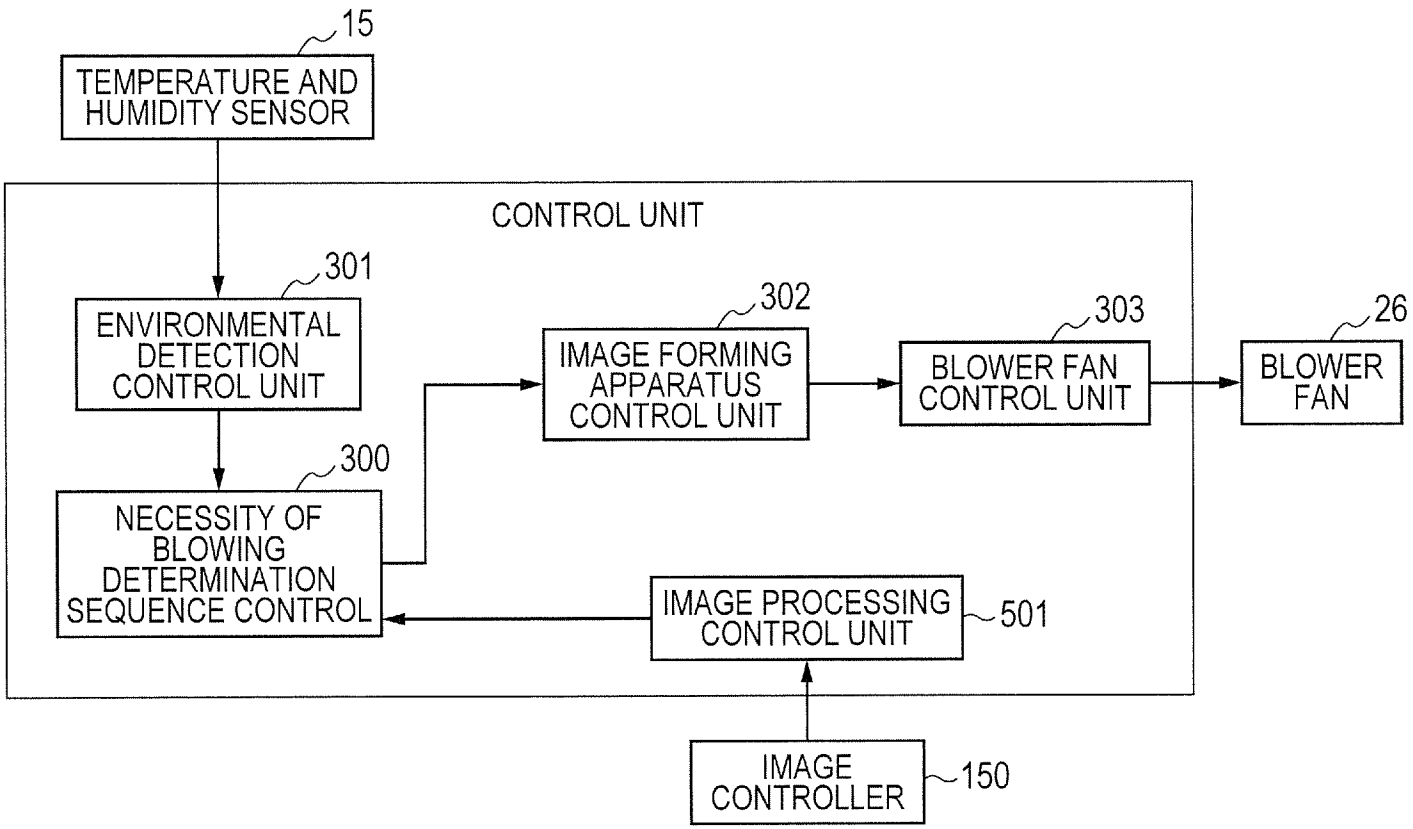
FIG. 5 is a block diagram of a determination of air supply sequence control according to Example 2.

FIG. 5 is a block diagram concerning determination of air supply sequence control according to Example 2. FIG. 5 is a block diagram in which the structure related to the image information is added to the block diagram of Example 1 illustrated in FIG. 3. A control unit 29 is constituted of a CPU and memories such as a RAM and a ROM, and includes the environmental detection control unit 301, the determination of air supply sequence control unit 300, the image forming apparatus management control unit 302, the air supply fan control unit 303, an image processing control unit (image information detection unit) 501, and the like.

In FIG. 5, there is disposed an image controller 150. The image controller 150 is configured to output a print instruction from the external device to the control unit 29 and to perform a predetermined process on the image information from the external device so as to output the processed image information to an image processing control unit 501. The image processing control unit 501 is configured to detect the print ratio of the unfixed toner image based on the image information from the image controller 150 and to store the print ratio.

The determination of air supply sequence control unit 300 is configured to determine whether or not supplying air by the air supply fan 26 is necessary based on relative humidity stored in the environmental detection control unit 301 and the print ratio stored in the image processing control unit 501.

Now, correlation among relative humidity, image information of the recording material P, particularly the print ratio, condensation slip, and pressure roller contamination in Example 2 is described. Conditions for investigating the condensation slip and the pressure roller contamination in Example 2 are as shown in Table 5. The thermal conductivity of the pressure roller was set to 0.4 W/(m·K) in Example 1, but the same was changed to 0.5 W/(m·K) in this example. Items of the environment temperature, the main body print history, the recording material, and the fixing target temperature are the same as those in Table 1 of Example 1.

TABLE 5

| | Condensation slip | Pressure roller contamination |
|---|---|---|
| Environment temperature | 15° C. | 15° C. |
| Main body print history | Left for three hours from last operation | Left for three hours from last operation |
| Recording material | CS680 A4 (Canon Marketing | Extra80 A4 (Canon Marketing |

TABLE 5-continued

| | Condensation slip | Pressure roller contamination |
|---|---|---|
| | Japan Inc.) | Japan Inc.) |
| Fixing target temperature | 200° C. | 200° C. |
| Thermal conductivity of pressure roller | 0.5 W/(m · K) | 0.5 W/(m · K) |

Table 6 shows situations of generation of the condensation slip and the pressure roller contamination when the supplying air by the air supply fan 26 was constantly performed in each relative humidity environment and each print ratio of Example 2.

TABLE 6

| | Print ratio (%) | | | | | | | | | |
|---|---|---|---|---|---|---|---|---|---|---|
| | 0 | | 5 | | 15 | | 50 | | 100 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 0/20 | Rank 1 | 0/20 | Rank 1 | 0/20 | Rank 1 | 0/20 | Rank 1 |
| 80 | ↑ | ↑ | ↑ | ↑ | ↑ | ↑ | ↑ | ↑ | ↑ | ↑ |
| 70 | ↑ | ↑ | ↑ | ↑ | ↑ | ↑ | ↑ | ↑ | ↑ | ↑ |
| 60 | ↑ | ↑ | ↑ | ↑ | ↑ | ↑ | ↑ | ↑ | ↑ | ↑ |
| 50 | ↑ | ↑ | ↑ | ↑ | ↑ | ↑ | ↑ | ↑ | ↑ | ↑ |
| 40 | ↑ | ↑ | ↑ | Rank 2 | ↑ | ↑ | ↑ | ↑ | ↑ | ↑ |
| 30 | ↑ | Rank 2 | ↑ | Rank 3 | ↑ | Rank 2 | ↑ | ↑ | ↑ | ↑ |
| 20 | ↑ | Rank 3 | ↑ | Rank 4 | ↑ | Rank 3 | ↑ | ↑ | ↑ | ↑ |
| 10 | ↑ | Rank 4 | ↑ | Rank 5 | ↑ | Rank 4 | ↑ | ↑ | ↑ | ↑ |

No condensation slip is generated in any relative humidity or in any print ratio. However, the pressure roller contamination is generated in a case where the print ratio is low and the relative humidity is low. In the low humidity environment, the electrostatic offset becomes conspicuous. When the print ratio is low, transfer dust toner generated in a low print ratio image such as a thin line, which is a cause of the offset toner, and fog toner generated in a non-image part are increased, and hence the pressure roller contamination is easily generated. When supplying air to the pressure roller 23 by the air supply fan 26 is performed in the state where the pressure roller contamination is liable to be generated, the pressure roller temperature is dropped so that pressure roller contamination is generated.

There is a tendency that the pressure roller contamination is generated more easily in a print ratio of 5% than in a print ratio of 0%. This is because, when there is an adequate print image, transfer dust toner is also generated in addition to fog toner generated in a non-print part, and hence the pressure roller contamination is more easily generated.

Table 7 shows situations of generation of the condensation slip and the pressure roller contamination when the supplying air by the air supply fan 26 is stopped in each relative humidity environment and print ratio in Example 2.

TABLE 7

| | Print ratio (%) | | | | | | | | | |
|---|---|---|---|---|---|---|---|---|---|---|
| | 0 | | 5 | | 15 | | 50 | | 100 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 5/20 | Rank 1 | 15/20 | Rank 1 | 19/20 | Rank 1 | 19/20 | Rank 1 |
| 80 | ↑ | ↑ | 2/20 | ↑ | 9/20 | ↑ | 17/20 | ↑ | 19/20 | ↑ |
| 70 | ↑ | ↑ | 0/20 | ↑ | 5/20 | ↑ | 15/20 | ↑ | 19/20 | ↑ |
| 60 | ↑ | ↑ | ↑ | ↑ | 2/20 | ↑ | 9/20 | ↑ | 17/20 | ↑ |
| 50 | ↑ | ↑ | ↑ | ↑ | 0/20 | ↑ | 5/20 | ↑ | 15/20 | ↑ |
| 40 | ↑ | ↑ | ↑ | ↑ | ↑ | ↑ | 2/20 | ↑ | 9/20 | ↑ |
| 30 | ↑ | ↑ | ↑ | ↑ | ↑ | ↑ | 0/20 | ↑ | 5/20 | ↑ |
| 20 | ↑ | ↑ | ↑ | ↑ | ↑ | ↑ | ↑ | ↑ | 2/20 | ↑ |
| 10 | ↑ | ↑ | ↑ | ↑ | ↑ | ↑ | ↑ | ↑ | 0/20 | ↑ |

No pressure roller contamination is generated in any relative humidity or in any print ratio. However, the condensation slip is generated in a case where the print ratio is high and the relative humidity is high. In a high humidity environment, the amount of water vapor generated from the recording material P is increased. When the print ratio is high, toner that covers the print surface side of the recording material P increases so that a passage of the water vapor to the print surface side is blocked, and the amount of water vapor to the pressure roller 23 is increased. Thus, the condensation slip is easily generated.

Influence of the print ratio to the condensation slip becomes conspicuous particularly on a low print ratio side, and it is understood that a degree of the condensation slip largely changes between 0 to 15%. When supplying air to the pressure roller 23 by the air supply fan 26 is not performed in the state where the condensation slip is liable to be generated, the condensation slip is generated.

When the control of the conventional example 1 is applied in which necessity of supplying air by the air supply fan 26 is determined only based on relative humidity, because the condensation slip is generated until the relative humidity is reduced to 20% when the print ratio is 100%, the control is performed so that supplying air by the air supply fan 26 is not performed when the relative humidity is equal to or less than 10%.

Table 8 shows situations of generation of the condensation slip and the pressure roller contamination in the control of Example 1 in which necessity of supplying air by the air supply fan 26 is determined only based on relative humidity in the relative humidity environment and the print ratio.

TABLE 8

| | Print ratio (%) | | | | | | | | | |
|---|---|---|---|---|---|---|---|---|---|---|
| | 0 | | 5 | | 15 | | 50 | | 100 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 0/20 | Rank 1 | 0/20 | Rank 1 | 0/20 | Rank 1 | 0/20 | Rank 1 |
| 80 | ↑ | ↑ | ↑ | ↑ | ↑ | ↑ | ↑ | ↑ | ↑ | ↑ |
| 70 | ↑ | ↑ | ↑ | ↑ | ↑ | ↑ | ↑ | ↑ | ↑ | ↑ |
| 60 | ↑ | ↑ | ↑ | ↑ | ↑ | ↑ | ↑ | ↑ | ↑ | ↑ |
| 50 | ↑ | ↑ | ↑ | ↑ | ↑ | ↑ | ↑ | ↑ | ↑ | ↑ |
| 40 | ↑ | ↑ | ↑ | Rank 2 | ↑ | ↑ | ↑ | ↑ | ↑ | ↑ |
| 30 | ↑ | Rank 2 | ↑ | Rank 3 | ↑ | Rank 2 | ↑ | ↑ | ↑ | ↑ |
| 20 | ↑ | Rank 3 | ↑ | Rank 4 | ↑ | Rank 3 | ↑ | ↑ | ↑ | ↑ |
| 10 | ↑ | Rank 1 | ↑ | Rank 1 | ↑ | Rank 1 | ↑ | ↑ | ↑ | ↑ |

When the necessity of supplying air by the air supply fan 26 is determined only based on relative humidity, no condensation slip is generated in any condition. However, although the pressure roller contamination is not generated in a relative humidity of 10% because supplying air by the air supply fan 26 is not performed, the pressure roller contamination is generated in some print ratio conditions at a relative humidity of 20 to 40%, because supplying air by the air supply fan 26 is performed.

When the thermal conductivity of the pressure roller is low, a sufficient effect is obtained in Example 1. However, when the thermal conductivity of the pressure roller becomes high, some pressure roller contamination may occur.

In Example 2 in which the determination of air supply sequence control is performed based on relative humidity and print ratio, the supplying air by the air supply fan 26 is not performed when no image defect due to the condensation slip occurs in Table 7. When the relative humidity and the print ratio are between values shown in Table 7, the relative humidity and the print ratio are regarded to be the larger values, respectively. For instance, when the relative humidity is 15% and the print ratio is 25%, the relative humidity is regarded to be 20%, and the print ratio is regarded to be 50%, which are the larger values.

In the determination of air supply sequence control of Example 2, control of inquiring that the image defect due to the condensation slip is not generated in Table 7 is regarded as determination of air supply sequence control A.

Figure 6:
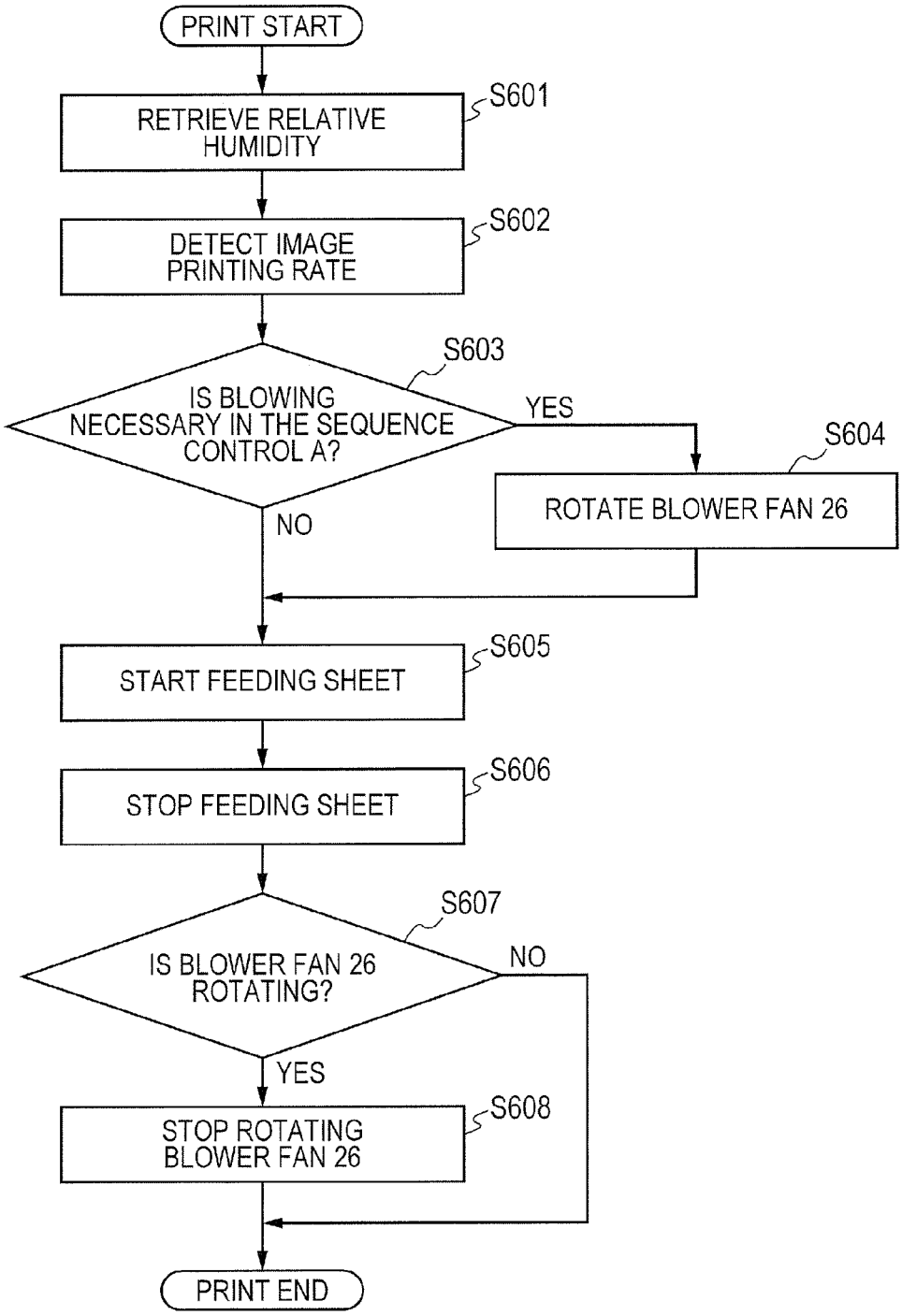
FIG. 6 is a flowchart of the determination of air supply sequence control according to Example 2.

FIG. 6 illustrates a flowchart of the determination of air supply sequence control according to Example 2. The flowchart illustrated in FIG. 6 is a flowchart in which print ratio detection (S602) is added to FIG. 4 of Example 1, and determination of air supply control sequence (S603) is changed to specification of this example.

When the control unit 29 receives the print instruction from the image controller 150, the environmental detection control unit 301 retrieves relative humidity from the temperature and humidity sensor 15 (S601), and the image processing control unit 501 retrieves the print ratio from the image controller 150 (S602). Thus, the control unit 29 performs the determination of air supply sequence control A (S603).

In S603, the determination of air supply sequence control unit 300 determines whether or not a combination of the relative humidity and the print ratio that are obtained in S601 and S602 corresponds to a combination of values at which the condensation slip is not generated in Table 7. When the combination corresponds to a combination of values at which the condensation slip is not generated (N), the instruction indicating that the supplying air is not necessary is output to the image forming apparatus management control unit 302. When the combination does not correspond to a combination of values at which the condensation slip is not generated (Y), the instruction indicating that the supplying air is necessary is output to the image forming apparatus management control unit 302. Because the process of S604 to S608 is the same as the process of S403 to S407 in Example 1, the description of S403 to S407 of Example 1 is used for Example 2.

Table 9 shows situations of generation of the condensation slip and the pressure roller contamination of Example 2 in which the determination of air supply control is performed based on each relative humidity and print ratio in each relative humidity environment and print ratio.

TABLE 9

| | Print ratio (%) | | | | | | | | | |
|---|---|---|---|---|---|---|---|---|---|---|
| | 0 | | 5 | | 15 | | 50 | | 100 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 0/20 | Rank 1 | 0/20 | Rank 1 | 0/20 | Rank 1 | 0/20 | Rank 1 |
| 80 | ↑ | ↑ | ↑ | ↑ | ↑ | ↑ | ↑ | ↑ | ↑ | ↑ |
| 70 | ↑ | ↑ | ↑ | ↑ | ↑ | ↑ | ↑ | ↑ | ↑ | ↑ |
| 60 | ↑ | ↑ | ↑ | ↑ | ↑ | ↑ | ↑ | ↑ | ↑ | ↑ |
| 50 | ↑ | ↑ | ↑ | ↑ | ↑ | ↑ | ↑ | ↑ | ↑ | ↑ |
| 40 | ↑ | ↑ | ↑ | ↑ | ↑ | ↑ | ↑ | ↑ | ↑ | ↑ |
| 30 | ↑ | ↑ | ↑ | ↑ | ↑ | ↑ | ↑ | ↑ | ↑ | ↑ |
| 20 | ↑ | ↑ | ↑ | ↑ | ↑ | ↑ | ↑ | ↑ | ↑ | ↑ |
| 10 | ↑ | ↑ | ↑ | ↑ | ↑ | ↑ | ↑ | ↑ | ↑ | ↑ |

In Example 2 in which the determination of air supply sequence control is performed based on the relative humidity and the print ratio, neither condensation slip nor pressure roller contamination is generated in any environment of the relative humidity and the print ratio shown in Table 9.

The above description is about the embodiment of the determination of air supply sequence control of Example 2. As described in Example 2, the condition where the supplying air by the air supply fan 26 is necessary is determined based on the relative humidity and the print ratio. Then, even when the condensation slip and the pressure roller contamination are liable to be generated because of increase of thermal conductivity of the pressure roller 23 or the like, it is possible to suppress the pressure roller contamination while preventing occurrence of the condensation slip.

Example 3

Another example of the determination of air supply sequence control is described.

In recent years, there are increasing image forming apparatus having multiple fixing target temperatures for supporting power saving of the image forming apparatus. For instance, there is an image forming apparatus having a normal print mode and an additional power saving mode in which the fixing target temperature is set 10° C. less than the normal print mode so as to reduce power consumption during printing.

By setting the fixing target temperature to a lower value, power saving can be achieved. However, when the fixing target temperature is low, temperature of the recording material P is lowered. As a result, toner fixing performance is lowered so that offset toner to the fixing film 21 is increased, and hence situation of the pressure roller contamination is changed.

In Example 3, there is described a case where the supplying air by the air supply fan 26 is determined based on the relative humidity and the fixing target temperature responding to increase of the pressure roller contamination when the target temperature of the heater 22 is lowered.

<Description of Supplying Air Control of Example 3>

Figure 7:
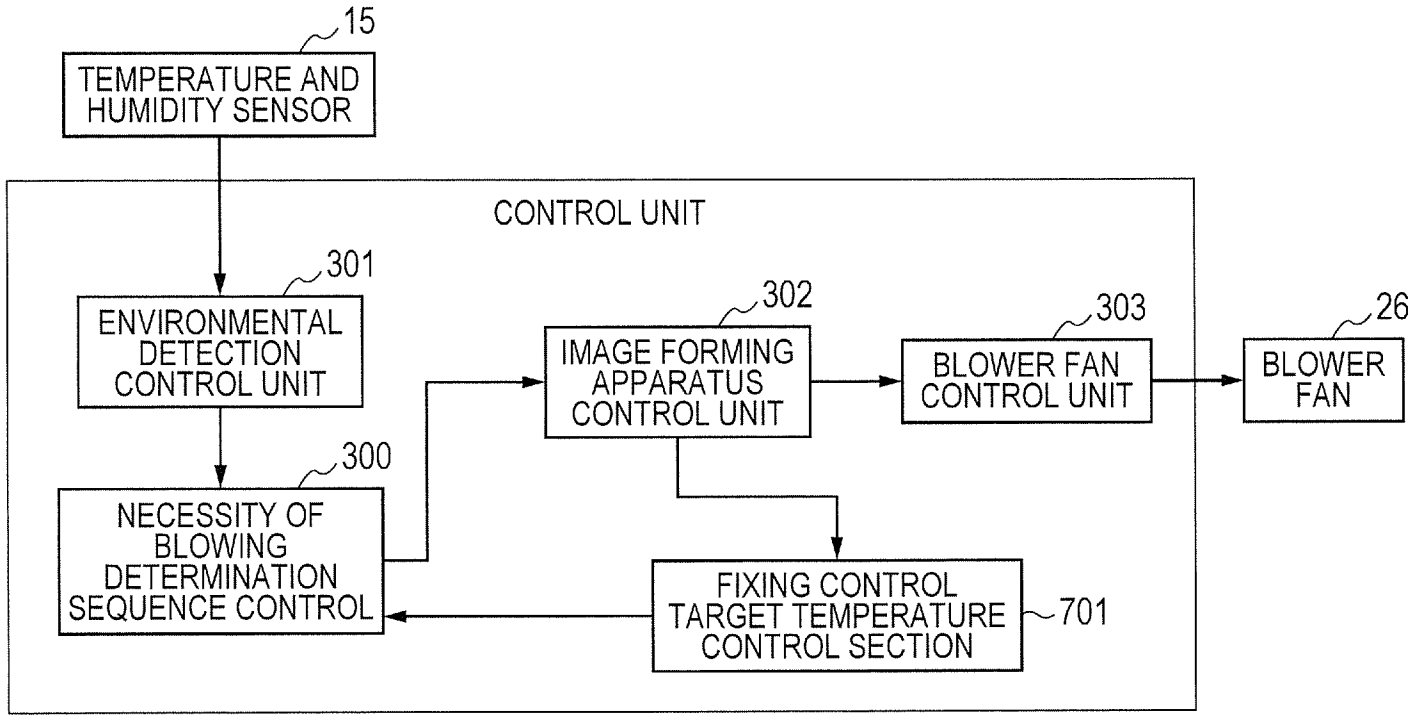
FIG. 7 is a block diagram of a determination of air supply sequence control according to Example 3.

FIG. 7 is a block diagram concerning determination of air supply sequence control according to Example 3. FIG. 7 is a block diagram in which the structure related to the target temperature is added to the block diagram of Example 1 illustrated in FIG. 1. A control unit 30 is constituted of a CPU and memories such as a RAM and a ROM, and includes the environmental detection control unit 301, the determination of air supply sequence control unit 300, the image forming apparatus management control unit 302, the air supply fan control unit 303, a fixing target temperature control unit 701, and the like.

The fixing target temperature control unit 701 is configured to retrieve the fixing target temperature from the image forming apparatus management control unit 302 and to store the fixing target temperature.

The determination of air supply sequence control unit 300 is configured to determine necessity of the supplying air by the air supply fan 26 based on the relative humidity stored in the environmental detection control unit 301 and the fixing target temperature stored in the fixing target temperature control unit 701.

Now, there is described a correlation among the relative humidity, the fixing target temperature, the condensation slip, and the pressure roller contamination in Example 3.

Investigation conditions for the condensation slip and the pressure roller contamination in Example 3 are shown in Table 10. The thermal conductivity of the pressure roller is 0.4 W/(m·K) similarly to Example 1. The items of the environment temperature, the main body print history, the recording material, and the fixing target temperature are the same as those in Table 1 of Example 1.

TABLE 10

| | Condensation slip | Pressure roller contamination |
|---|---|---|
| Environment temperature | 15° C. | 15° C. |
| Main body print history | Left for three hours from last operation | Left for three hours from last operation |
| Recording material | CS680 A4 (Canon Marketing Japan Inc.) | Extra80 A4 (Canon Marketing Japan Inc.) |
| Print ratio | 100% | 5% (character image) |
| Thermal conductivity of pressure roller | 0.4 W/(m · K) | 0.4 W/(m · K) |

Table 11 shows situations of generation of the condensation slip and the pressure roller contamination when the supplying air by the air supply fan 26 was constantly performed in each relative humidity environment and each fixing target temperature of Example 3.

TABLE 11

| | Fixing target temperature (° C.) | | | | | | | | | |
|---|---|---|---|---|---|---|---|---|---|---|
| | 180 | | 185 | | 190 | | 195 | | 200 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 0/20 | Rank 1 | 0/20 | Rank 1 | 0/20 | Rank 1 | 0/20 | Rank 1 |
| 80 | ↑ | ↑ | ↑ | ↑ | ↑ | ↑ | ↑ | ↑ | ↑ | ↑ |
| 70 | ↑ | ↑ | ↑ | ↑ | ↑ | ↑ | ↑ | ↑ | ↑ | ↑ |
| 60 | ↑ | Rank 2 | ↑ | ↑ | ↑ | ↑ | ↑ | ↑ | ↑ | ↑ |
| 50 | ↑ | Rank 3 | ↑ | Rank 2 | ↑ | ↑ | ↑ | ↑ | ↑ | ↑ |
| 40 | ↑ | Rank 4 | ↑ | Rank 3 | ↑ | Rank 2 | ↑ | ↑ | ↑ | ↑ |
| 30 | ↑ | Rank 5 | ↑ | Rank 4 | ↑ | Rank 3 | ↑ | Rank 2 | ↑ | ↑ |
| 20 | ↑ | Rank 5 | ↑ | Rank 5 | ↑ | Rank 4 | ↑ | Rank 3 | ↑ | Rank 2 |
| 10 | ↑ | Rank 5 | ↑ | Rank 5 | ↑ | Rank 5 | ↑ | Rank 4 | ↑ | Rank 3 |

No condensation slip is generated in any relative humidity of in every fixing target temperature. However, the pressure roller contamination is generated in a case where the fixing target temperature is low and the relative humidity is low. In the low humidity environment, the electrostatic offset becomes conspicuous. When the fixing target temperature is low, the offset toner is increased due to the lowered fixing performance, and hence the pressure roller contamination is easily generated. When supplying air to the pressure roller 23 by the air supply fan 26 is performed in the state where the pressure roller contamination is liable to be generated, the surface temperature of the pressure roller is dropped so that pressure roller contamination is generated.

Table 12 shows situations of generation of the condensation slip and the pressure roller contamination when the supplying air by the air supply fan 26 is stopped in each relative humidity environment and fixing target temperature in this example.

TABLE 12

| | Fixing target temperature (° C.) | | | | | | | | | |
|---|---|---|---|---|---|---|---|---|---|---|
| | 180 | | 185 | | 190 | | 195 | | 200 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 0/20 | Rank 1 | 5/20 | Rank 1 | 15/20 | Rank 1 | 19/20 | Rank 1 |
| 80 | ↑ | ↑ | ↑ | ↑ | 2/20 | ↑ | 9/20 | ↑ | 17/20 | ↑ |
| 70 | ↑ | ↑ | ↑ | ↑ | 0/20 | ↑ | 5/20 | ↑ | 15/20 | ↑ |
| 60 | ↑ | ↑ | ↑ | ↑ | ↑ | ↑ | 2/20 | ↑ | 9/20 | ↑ |
| 50 | ↑ | ↑ | ↑ | ↑ | ↑ | ↑ | 0/20 | ↑ | 5/20 | ↑ |
| 40 | ↑ | ↑ | ↑ | ↑ | ↑ | ↑ | ↑ | ↑ | 2/20 | ↑ |
| 30 | ↑ | ↑ | ↑ | ↑ | ↑ | ↑ | ↑ | ↑ | 0/20 | ↑ |
| 20 | ↑ | ↑ | ↑ | ↑ | ↑ | ↑ | ↑ | ↑ | ↑ | ↑ |
| 10 | ↑ | ↑ | ↑ | ↑ | ↑ | ↑ | ↑ | ↑ | ↑ | ↑ |

No pressure roller contamination is generated in any relative humidity or in any fixing target temperature. However, the condensation slip is generated in a case where the fixing target temperature is high and the relative humidity is high. In the high humidity environment, the amount of water vapor generated from the recording material P is increased. When the fixing target temperature is high, temperature of the recording material P is raised. As a result, the amount of water vapor generated from the recording material P is increased so that the condensation slip is easily generated. When supplying air to the pressure roller 23 by the air supply fan 26 is not performed in the state where the condensation slip is liable to be generated, the condensation slip is generated.

When the control of the conventional example 1 is applied, in which necessity of supplying air by the air supply fan 26 is determined only based on relative humidity, because the condensation slip is generated in the case where the relative humidity is 40% when the fixing target temperature is 200° C., the control is performed so that supplying air by the air supply fan 26 is not performed when the relative humidity is equal to or less than 30%.

Table 13 shows situations of generation of the condensation slip and the pressure roller contamination in the control of Example 1 in which necessity of supplying air by the air supply fan 26 is determined only based on relative humidity in the relative humidity environment and the fixing target temperature.

TABLE 13

| | Fixing target temperature (° C.) | | | | | | | | | |
|---|---|---|---|---|---|---|---|---|---|---|
| | 180 | | 185 | | 190 | | 195 | | 200 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 0/20 | Rank 1 | 0/20 | Rank 1 | 0/20 | Rank 1 | 0/20 | Rank 1 |
| 80 | ↑ | ↑ | ↑ | ↑ | ↑ | ↑ | ↑ | ↑ | ↑ | ↑ |
| 70 | ↑ | ↑ | ↑ | ↑ | ↑ | ↑ | ↑ | ↑ | ↑ | ↑ |
| 60 | ↑ | Rank 2 | ↑ | ↑ | ↑ | ↑ | ↑ | ↑ | ↑ | ↑ |
| 50 | ↑ | Rank 3 | ↑ | Rank 2 | ↑ | ↑ | ↑ | ↑ | ↑ | ↑ |
| 40 | ↑ | Rank 4 | ↑ | Rank 3 | ↑ | Rank 2 | ↑ | ↑ | ↑ | ↑ |
| 30 | ↑ | Rank 1 | ↑ | Rank 1 | ↑ | Rank 1 | ↑ | ↑ | ↑ | ↑ |
| 20 | ↑ | ↑ | ↑ | ↑ | ↑ | ↑ | ↑ | ↑ | ↑ | ↑ |
| 10 | ↑ | ↑ | ↑ | ↑ | ↑ | ↑ | ↑ | ↑ | ↑ | ↑ |

When the necessity of supplying air by the air supply fan 26 is determined only based on relative humidity, no condensation slip is generated in any condition. Also the pressure roller contamination is not generated in a relative humidity of 30% because supplying air by the air supply fan 26 is not performed. On the other hand, the pressure roller contamination is generated in some fixing target temperature conditions at a relative humidity of 40 to 60%, because supplying air by the air supply fan 26 is performed.

When the fixing target temperature is high, a sufficient effect is obtained in Example 1. However, when the fixing target temperature becomes low, some pressure roller contamination may occur.

In Example 3 in which the determination of air supply control is performed based on relative humidity and fixing target temperature, the supplying air by the air supply fan 26 is not performed when no image defect due to the condensation slip occurs in Table 12. When the relative humidity and the fixing target temperature are between values shown in Table 12, the relative humidity and the fixing target temperature are regarded to be the larger values, respectively. For instance, when the relative humidity is 15% and the fixing target temperature is 183° C., the relative humidity is regarded to be 20%, and the fixing target temperature is regarded to be 185° C., which are the larger values.

In the control of Example 3, control of inquiring that the image defect due to the condensation slip is not generated in Table 12 is regarded as determination of air supply sequence control B.

Figure 8:
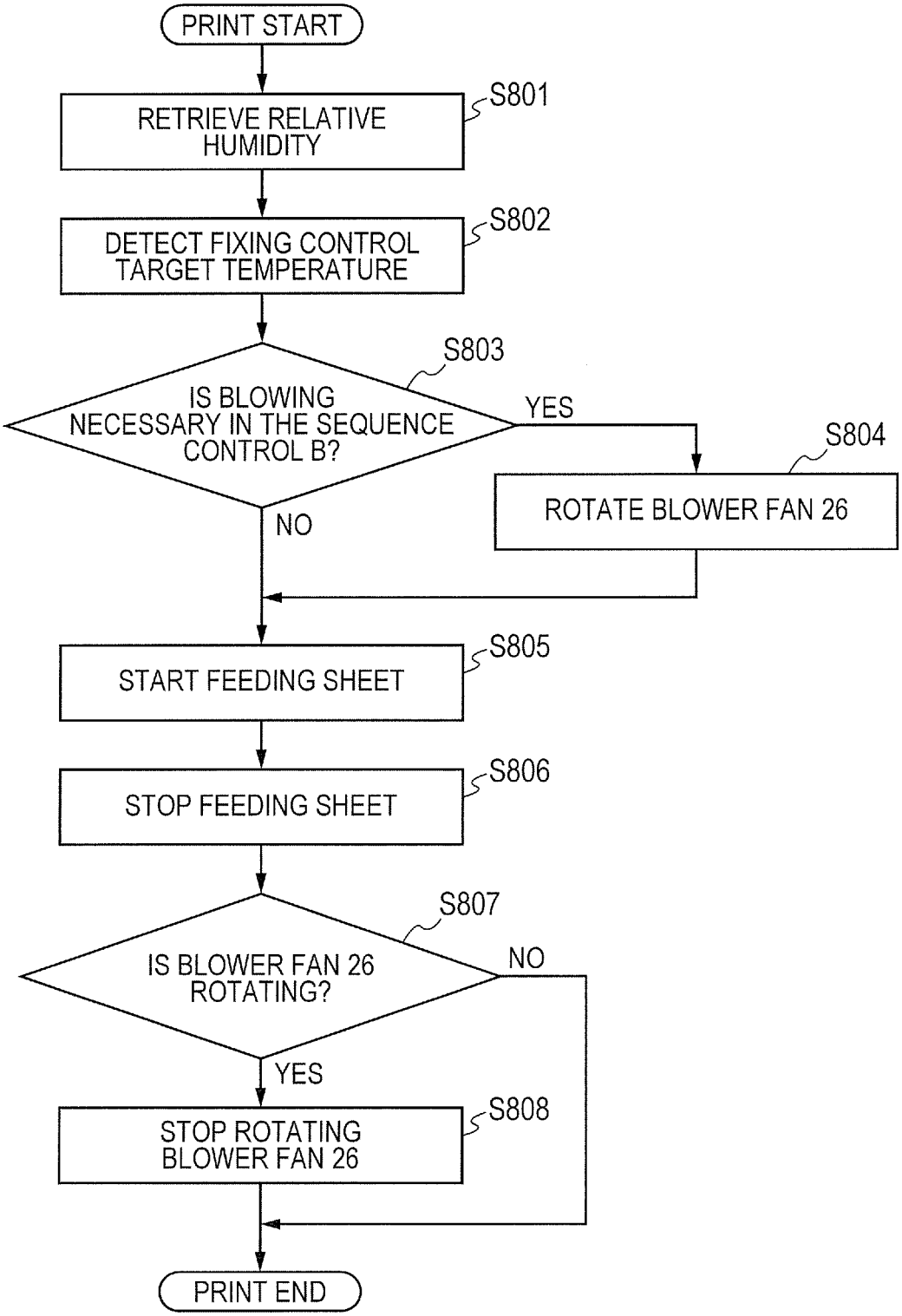
FIG. 8 is a flowchart of the determination of air supply sequence control according to Example 3.

FIG. 8 illustrates a flowchart of the determination of air supply sequence control according to Example 3. The flowchart illustrated in FIG. 8 is a flowchart in which fixing target temperature detection (S802) is added to FIG. 4 of Example 1, and determination of air supply control sequence (S803) is changed to specification of this example.

When the control unit 30 receives the print instruction, the environmental detection control unit 301 retrieves relative humidity from the temperature and humidity sensor 15 (S801), and the fixing target temperature control unit 701 retrieves the fixing target temperature from the image forming apparatus management control unit 302 (S802). Thus, the control unit 30 performs the determination of air supply sequence control B (S803).

In S803, the determination of air supply sequence control unit 300 determines whether or not a combination of the relative humidity and the fixing target temperature that are obtained in S801 and S802 corresponds to a combination of values at which the condensation slip is not generated in Table 12. When the combination corresponds to a combination of values at which the condensation slip is not generated (N), the instruction indicating that the supplying air is not necessary is output to the image forming apparatus management control unit 302. When the combination does not correspond to a combination of values at which the condensation slip is not generated (Y), the instruction indicating that the supplying air is necessary is output to the image forming apparatus management control unit 302.

Because the process of S804 to S808 is the same as the process of S403 to S407 in Example 1, the description of S403 to S407 of Example 1 is used for Example 3.

Table 14 shows situations of generation of the condensation slip and the pressure roller contamination in the case of the control of Example 3 where the supplying air by the air supply fan 26 is determined based on the relative humidity and the fixing target temperature in each relative humidity environment and fixing target temperature.

TABLE 14

| | Fixing target temperature (° C.) | | | | | | | | | |
|---|---|---|---|---|---|---|---|---|---|---|
| | 180 | | 185 | | 190 | | 195 | | 200 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 90 | 0/20 | Rank 1 | 0/20 | Rank 1 | 0/20 | Rank 1 | 0/20 | Rank 1 | 0/20 | Rank 1 |
| 80 | ↑ | ↑ | ↑ | ↑ | ↑ | ↑ | ↑ | ↑ | ↑ | ↑ |
| 70 | ↑ | ↑ | ↑ | ↑ | ↑ | ↑ | ↑ | ↑ | ↑ | ↑ |
| 60 | ↑ | ↑ | ↑ | ↑ | ↑ | ↑ | ↑ | ↑ | ↑ | ↑ |
| 50 | ↑ | ↑ | ↑ | ↑ | ↑ | ↑ | ↑ | ↑ | ↑ | ↑ |

TABLE 14-continued

| | Fixing target temperature (° C.) | | | | | | | | | |
|---|---|---|---|---|---|---|---|---|---|---|
| | 180 | | 185 | | 190 | | 195 | | 200 | |
| Relative humidity % | Condensation slip | Pressure roller contamination | Condensation slip | Pressure roller contamination | Condensation slip | Pressure roller contamination | Condensation slip | Pressure roller contamination | Condensation slip | Pressure roller contamination |
| 40 | ↑ | ↑ | ↑ | ↑ | ↑ | ↑ | ↑ | ↑ | ↑ | ↑ |
| 30 | ↑ | ↑ | ↑ | ↑ | ↑ | ↑ | ↑ | ↑ | ↑ | ↑ |
| 20 | ↑ | ↑ | ↑ | ↑ | ↑ | ↑ | ↑ | ↑ | ↑ | ↑ |
| 10 | ↑ | ↑ | ↑ | ↑ | ↑ | ↑ | ↑ | ↑ | ↑ | ↑ |

In Example 3 in which the determination of air supply sequence control is performed based on the relative humidity and the fixing target temperature, neither condensation slip nor pressure roller contamination is generated in any environment of the relative humidity and the fixing target temperature shown in Table 14.

The above description is about the embodiment of the determination of air supply sequence control of Example 3. As described in Example 3, the condition where the supplying air by the air supply fan 26 is necessary is determined based on the relative humidity and the fixing target temperature. Then, even when the fixing target temperature is low, it is possible to suppress the pressure roller contamination while preventing occurrence of the condensation slip.

Other Examples

It is possible to add the image information described in Example 2 to the determination of air supply control sequence of Example 3 so as to obtain a larger effect.

The fixing apparatus B may be a heating roller type fixing apparatus without limiting to the film heating type fixing apparatus. The heating roller type fixing apparatus includes a fixing roller (heating member) maintained at a predetermined temperature, a pressure roller (pressure member) that comes into contact with the fixing roller so as to form the fixing nip portion, and the like. The recording material bearing an unfixed toner image is sandwiched and conveyed by the fixing nip portion, and hence the unfixed toner image is heated by the fixing roller and is fixed to the recording material. In the image forming apparatus including the heating roller type fixing apparatus, it is possible to adopt the determination of air supply sequence control according to Example 1, Example 2, or Example 3 to the pressure roller of the fixing apparatus so that the same action and effect can be obtained.

Example 4

Description of an image forming apparatus and a fixing apparatus of Example 4 is omitted because the fixing apparatus has the same structure as the fixing apparatus B of Example 1. Example 4 is different from Examples 1 to 3 in control for suppressing the condensation slip.

When the target temperature of the fixing apparatus is increased so that the printer can pint at high speed, an amount of water vapor generated in the fixing process may increase. In the case where there is a large amount of water vapor generated in the fixing process, in order to suppress the condensation on the pressure roller only by the method of discharging water vapor to the outside by the supplying air by the air supply fan as in Examples 1 to 3, it is necessary to increase air flow amount of the fan. Then, temperature of the pressure roller is easily dropped. When the temperature of the pressure roller is dropped, the pressure roller contamination is easily increased as described above. In addition, in order to increase air flow amount of the air supply fan, it is necessary to upsize the fan.

On the other hand, it is conceivable to adopt a method of extending a warm-up period of the fixing apparatus for warming the pressure roller so that the condensation does not occur, instead of the supplying air by the air supply fan. However, when the warm-up period is extended, there is a problem in that the FPOT is elongated.

Therefore, this example is aimed at achieving both suppression of the condensation slip and suppression of the pressure roller contamination by extending the warm-up period in addition to the supplying air by the fan.

Necessity of the supplying air by the fan and necessity of extension of the warm-up period are determined based on a correlation value that becomes larger as an amount of water vapor generated from the recording material P becomes larger. As described above in Examples 1 to 3, the amount of water vapor generated from the recording material P in the fixing process is estimated from temperature and humidity of the environment where the image forming apparatus is installed, a target temperature of the fixing apparatus, a print ratio on the recording material, and a size of the recording material.

The correlation value α is calculated from the following equation (1) for A4 size recording material or the following equation (2) for A3 size recording material. The calculated value of this example is a warm-up extension period (sec) necessary for preventing condensation on the pressure roller in a state where supplying air by the air supply fan to the pressure roller is performed at a predetermined air flow amount when temperature of the pressure roller is at a predetermined temperature.

$$(\text{for } A4)\ \alpha = 0.51\,H - 0.26\,T + 0.08\,\text{Target} - 46.27\ (\text{sec}) \quad (1)$$

$$(\text{for } A3)\ \alpha = 0.31\,H - 0.26\,T + 0.6\,\text{Target} - 124.44\ (\text{sec}) \quad (2)$$

In those expressions, H represents relative humidity (%), T represents environment temperature (° C.), and Target represents target temperature.

When the print ratio is equal to or more than 50%, 10 is added to each of the calculated values of the above equations for correction.

Table 15 shows a relationship among the calculated value of the equation (1) or the equation (2), the warm-up extension period, and ON/OFF of drive of the air supply fan 26. When the calculated value (correlation value) α of the equation (1) or the equation (2) is −5.0 or larger and 0.0 or smaller, only the drive of the air supply fan 26 is performed, and extension of the warm-up period is not performed (first mode). When the calculated value of the equation (1) or the equation (2) is larger than 0, the air supply fan 26 is driven, and the warm-up period is extended by the calculated value (second mode). When the calculated value of the equation (1) or the equation (2) is smaller than −5.0, both the drive of the air supply fan 26 and the extension of the warm-up period are not performed (third mode). Further, in the second mode, the warm-up extension period becomes longer as the calculated value becomes larger.

TABLE 15

| Calculated value (correlation value) of equation (1) or (2) | Air supply fan drive (ON/OFF) | Warm-up extension period |
|---|---|---|
| $\alpha > 0$ (Second mode) | ON | $\alpha$ (sec) |
| $-5 \leq \alpha \leq 0$ (First mode) | ON | 0 (sec) |
| $\alpha < -5$ (Third mode) | OFF | 0 (sec) |

Figure 10:
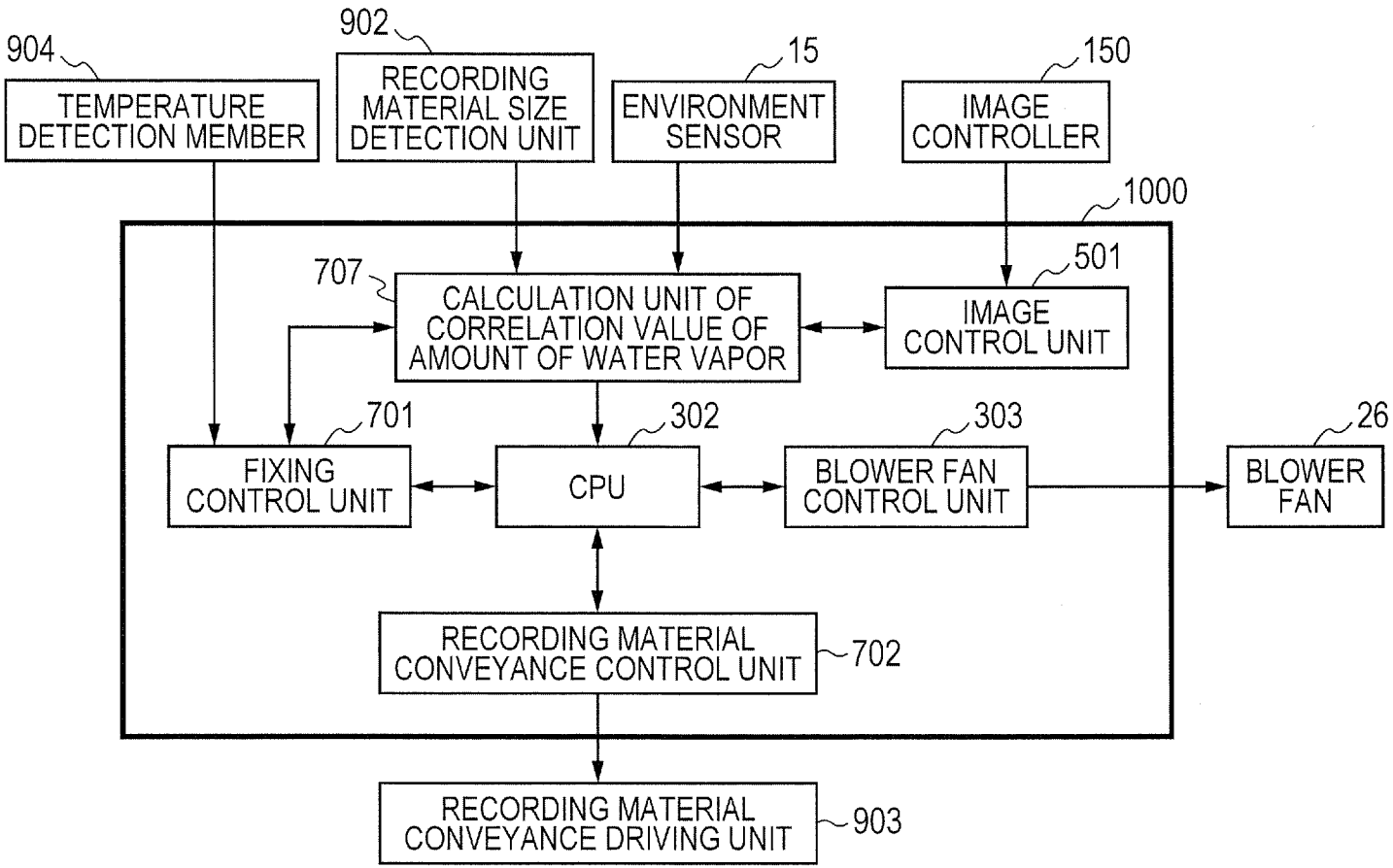
FIG. 10 is a block diagram of control of fan drive and the warm-up period according to Example 4.

Here, FIG. 10 illustrates a block diagram for performing control of the air supply fan drive and the warm-up period in Example 4. A control unit 1000 includes a CPU 302, the fixing control unit 701, the image control unit 501, the air supply fan control unit 303, a recording material conveyance control unit 702, and a calculation unit 707 of a correlation value of an amount of water vapor. The calculation unit 707 for the correlation value of an amount of water vapor obtains image information (print ratio) from the image controller 150 via the image control unit 501, temperature information from the fixing control unit 701, size information of the recording material from a recording material size detection unit, and temperature and humidity information from the environment sensor 15, so as to calculate the correlation value. When the correlation value is obtained, the CPU 302 controls ON/OFF of the fan drive via the air supply fan control unit 303 in accordance with the correlation value. In addition, the CPU 302 controls a recording material conveyance driving unit 903 via the recording material conveyance control unit 702 so as to control timing of feeding the recording material to the fixing nip portion N, thereby controlling the warm-up period.

The warm-up period described in Example 4 means a period from a time when the pressure roller 23 in FIG. 2 is driven so that the film 21 rotates to follow the roller and the heater 22 is provided with power, until a time when temperature detected by the thermistor 25 reaches the target temperature so that the fixing apparatus B can perform fixing. In the fixing apparatus of Example 4, the warm-up period is a period until temperature of the heater 22 reaches the target temperature, and hence is determined based on temperature of the heater 22. Therefore, the warm-up period is different depending on the environment where the apparatus is installed, a print history, and the like.

Figure 9:
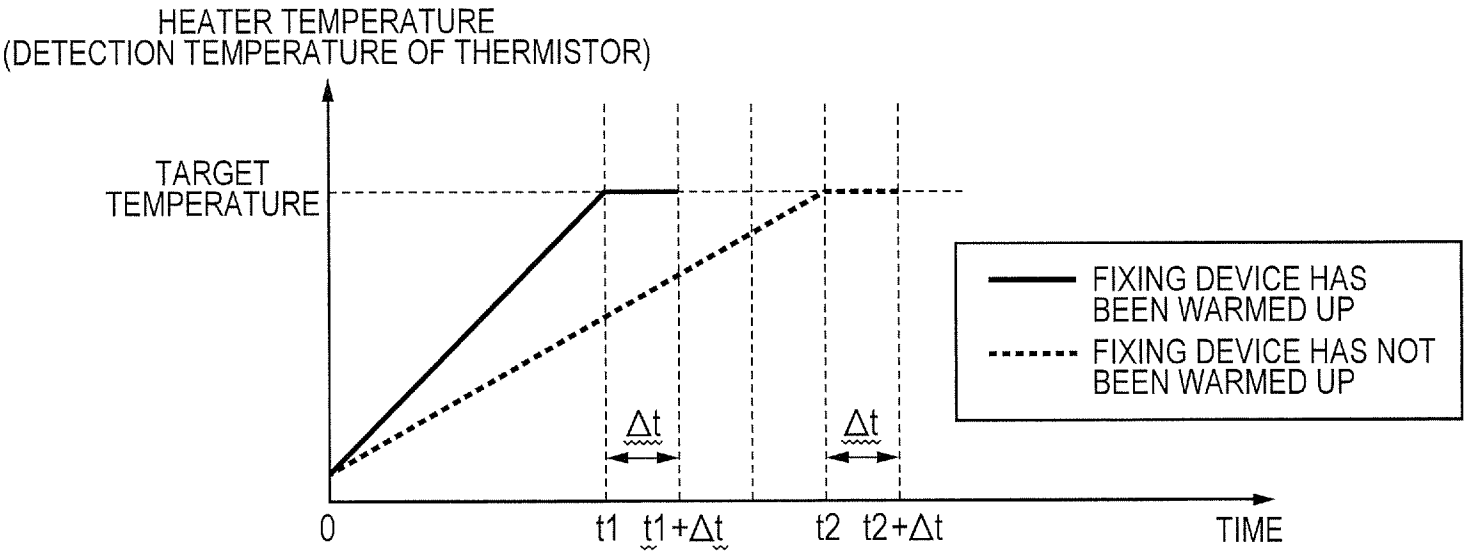
FIG. 9 is a graph showing a warm-up period of a fixing apparatus according to Example 4.

Next, the warm-up period extension in Example 4 is described. FIG. 9 is a graph showing temperature change of the heater 22 during performing the warm-up in a case where the fixing apparatus is warmed up and in a case where the fixing apparatus is not yet warmed up. In both cases, the correlation value related to an amount of water vapor generated from the recording material in the fixing process is the same, and the warm-up extension period is Δt. The vertical axis represents temperature detected by the thermistor 25, and the horizontal axis represents elapsed time from start of supplying air power to the heater 22. A period t2 until the temperature detected by the thermistor 25 reaches the target temperature in the case where the fixing apparatus is not yet warmed up is longer than a period t1 until the temperature detected by the thermistor 25 reaches the target temperature in the case where the fixing apparatus is warmed up. In other words, in the case where the fixing apparatus is warmed up, the warm-up period in the first mode is t1, and the warm-up period in the second mode is t1+Δt. Similarly, in the case where the fixing apparatus is not warmed up, the warm-up period in the first mode is t2, and the warm-up period in the second mode is t2+Δt.

As described above, this example has an effect that both suppression of the pressure roller contamination and suppression of the condensation slip can be achieved, by extending the warm-up period in addition to the fan drive, in accordance with an amount of water vapor generated from the recording material P.

In this example, there are two measures against the condensation, including supplying air by the air supply fan and extension of the warm-up period. Both of the measures are used in the second mode, but only supplying air by the air supply fan is used in the first mode. The reason of this is to shorten FPOT as much as possible. In this example, extension of the warm-up period is used as an assist to the supplying air by the air supply fan.

Further, the air supply fan in the second mode has a constant air flow amount independent of the correlation value. The air supply fan in the first mode may be controlled to have larger air flow amount as the correlation value becomes larger.

In addition, it is possible not to turn on the air supply fan drive in the third mode and the first mode, but to turn on the air supply fan drive only in the second mode.

Example 5

A fixing apparatus in Example 5 is the same as that of Example 1, and overlapping description thereof is omitted. Example 5 is a developed variation of Example 4. In Example 4, the air supply fan drive and the warm-up period extension are performed in accordance with an amount of water vapor generated from the recording material P regarding that the pressure roller is at a predetermined temperature. However, in this example, change of temperature of the pressure roller is also considered. This is because even when the same amount of water vapor is generated from the recording material P, the condensation on the pressure roller occurs more hardly in the case where temperature of the pressure roller 23 is high than in the case where the temperature of the pressure roller 23 is low.

In order to estimate the temperature of the pressure roller 23 from the print history, a parameter called a "warm counter" is used. As a value of the warm counter becomes larger, temperature of the pressure roller 23 becomes larger. The value is incremented by one every time when one sheet is printed, and a final value of the warm counter is calculated from the elapsed time after finishing the last printing and a value of the thermistor 25 (temperature detection member).

A relationship between temperature detected by the thermistor 25 and addition of the warm counter is shown in Table 16. A relationship between the elapsed time after finishing the last printing and the warm counter is shown in Table 17.

TABLE 16

| Temperature detected by thermistor | Warm counter |
|---|---|
| Less than 40° C. | 1 |
| 40° C. or more and less than 50° C. | 5 |
| 50° C. or more and less than 65° C. | 50 |
| 65° C. or more and less than 80° C. | 150 |
| 80° C. or more | 200 |

TABLE 17

| Elapsed time after finishing last printing | Warm counter to be added |
|---|---|
| Less than 40 seconds after last printing | Current value +20 |
| 40 seconds or more and less than 240 seconds after last printing | Current value +15 |
| 240 seconds or more and less than 450 seconds after last printing | Current value +10 |
| 450 seconds or more and less than 900 seconds after last printing | Current value +0 |
| 900 seconds or more after last printing | Temperature detected by thermistor * see Table 18 |

The equation (1) and the equation (2) for calculating values corresponding to amount of water vapor generated from the recording material are corrected in accordance with the warm counter.

The equation (1) and the equation (2) are corrected by correction value A corresponding to the warm counter, so as to be the equation (3) and the equation (4), respectively. A relationship between the correction value A and the warm counter value is shown in Table 18.

$$(\text{for } A4)\ \alpha=0.51\,H-0.26\,T+0.08\,\text{Target}-46.27-A\ (\text{sec}) \quad (3)$$

$$(\text{for } A3)\ \alpha=0.31\,H-0.26\,T+0.6\,\text{Target}-124.44-A\ (\text{sec}) \quad (4)$$

TABLE 18

| Warm counter β | A |
|---|---|
| 1 = β | 0 |
| 1 < β < 10 | 1 |
| 10 ≤ β < 20 | 5 |
| 30 ≤ β < 50 | 10 |
| 50 ≤ β < 100 | 20 |
| 100 ≤ β < 200 | 30 |
| 200 ≤ β | 50 |

The value A becomes large when the pressure roller is warmed up, and calculated values of the equation (3) and the equation (4) are smaller than the calculated values of the equation (1) and the equation (2) in Example 4. Therefore, the air supply fan drive and the warm-up period extension are hardly performed. This means that the fan drive and the warm-up period extension are performed only when the fan drive and the warm-up period extension are necessary in Example 5 than in Example 4.

Therefore, Example 5 has an effect that the pressure roller contamination hardly occurs and the FPOT is shorter compared with Example 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-160327, filed Jul. 19, 2012, and Japanese Patent Application No. 2013-140617, filed Jul. 4, 2013, which are hereby incorporated by reference herein in their entirety.

What is claimed is:

1. A fixing apparatus for performing a fixing process in which an unfixed toner image is fixed on a recording material while conveying the recording material bearing the unfixed toner image at a nip portion, the fixing apparatus comprising:

a first rotary member configured to contact the unfixed toner image;

a second rotary member configured to form the nip portion with the first rotary member; and an air supply unit configured to supply air to the second rotary member, wherein the fixing apparatus is configured to execute a first mode in which a warm-up for warming the second rotary member while rotating the first rotary member and the second rotary member is performed for a period of the warm-up before the fixing process and in which supplying air by the air supply unit for a period of the fixing process is performed, a second mode in which the warm-up is performed for a longer period than the period of warm-up in the first mode and in which supplying air by the air supply unit is performed for the period of the fixing process, and a third mode in which the warm-up is performed for the same period as the period of the warm-up in the first mode and in which supplying air by the air supply unit is not performed, independently of the number of the recording materials on which the unfixed toner images are continuously fixed, for an entire period of the fixing process.

2. The fixing apparatus according to claim 1, further comprises:

a heater for heating the first rotary member;

a temperature detection member for detecting temperature of one of the heater and the first rotary member; and a control unit that controls power supply to the heater so as to maintain the temperature detected by the temperature detection member at a target temperature, wherein a period of the warm-up in the first mode is a period from a time when the power supply to the heater is started to a time when the temperature detected by the temperature detection member reaches the target temperature; and wherein a period of the warm-up in the second mode is a period in which an extension period is added to the period of the warm-up in the first mode.

3. The fixing apparatus according to claim 2, wherein air quantity of the air supply unit in the second mode is constant independent of an amount of water vapor generated from the recording material in the fixing process; and the extension period in the second mode becomes longer according to the amount of the water vapor generated from the recording material in the fixing process becomes larger.

4. The fixing apparatus according to claim 2, wherein the air quantity of the air supply unit in the second mode is constant independent of a correlation value of the amount of water vapor generated from the recording material in the fixing process of the recording material, and the correlation value becomes larger as the amount of the water vapor becomes larger.

5. The fixing apparatus according to claim 2, wherein a correlation value of the amount of water vapor generated from the recording material in the fixing process of the recording material, the correlation value becoming larger as the amount of the water vapor becomes larger, is defined, and wherein the larger the correlation value becomes, the larger the air quantity of the air supply unit in the first mode.

6. The fixing apparatus according to claim 1, further comprising:

a heater configured to heat the first rotary member;

a temperature detection member configured to detect the temperature of one of the heater and the first rotary member; and a control unit configured to control power supply to the heater so as to maintain the temperature detected by the temperature detection member at a target temperature, wherein a period of the warm-up in the first mode and the third mode is a period from a time when the power supply to the heater is started to a time when the temperature detected by the temperature detection member reaches the target temperature, and wherein a period of the warm-up in the second mode is a period in which an extension period is added to the period of the warm-up in the first mode.

7. The fixing apparatus according to claim 6, wherein the air quantity of the air supply unit in the second mode is constant independent of the amount of water vapor generated from the recording material in the fixing process, and the extension period in the second mode becomes longer as the amount of the water vapor generated from the recording material in the fixing process becomes larger.

8. The fixing apparatus according to claim 1, wherein in a case where a correlation value of the amount of water vapor generated from the recording material in the fixing process of the recording material is smaller than a first threshold value, the correlation value becomes larger as the amount of the water vapor becomes larger, and the fixing apparatus executes the third mode, wherein in a case where the correlation value is equal to or larger than the first threshold value and equal to or smaller than a second threshold value that is larger than the first threshold value, the fixing apparatus executes the first mode, and wherein in a case where the correlation value is larger than the second threshold value, the fixing apparatus executes the second mode.

9. The fixing apparatus according to claim 8, wherein the air quantity of the air supply unit in the second mode is constant independent of the correlation value.

10. The fixing apparatus according to claim 8, wherein the larger the correlation value becomes, the larger the air quantity of the air supply unit in the first mode.

11. The fixing apparatus according to claim 8, wherein the correlation value is determined based on information on an environment in which the fixing apparatus is installed and fixing temperature information.

12. The fixing apparatus according to claim 8, wherein the correlation value is calculated based on information on an environment in which the fixing apparatus is installed, fixing temperature information, a print ratio of the unfixed toner image, and a size of the recording material.

13. The fixing apparatus according to claim 8, wherein the correlation value is relative humidity.

* * * * *